US008519605B2

(12) United States Patent
Kanazawa et al.

(10) Patent No.: US 8,519,605 B2
(45) Date of Patent: Aug. 27, 2013

(54) METAL VAPOR DISCHARGE LAMP AND LIGHTING APPARATUS

(75) Inventors: Yukiya Kanazawa, Osaka (JP); Atsushi Utsubo, Osaka (JP); Shunsuke Kakisaka, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/387,691

(22) PCT Filed: May 2, 2011

(86) PCT No.: PCT/JP2011/002537

§ 371 (c)(1),
(2), (4) Date: Jan. 27, 2012

(87) PCT Pub. No.: WO2012/017581

PCT Pub. Date: Feb. 9, 2012

(65) Prior Publication Data

US 2012/0267994 A1 Oct. 25, 2012

(30) Foreign Application Priority Data

Aug. 6, 2010 (JP) ..... 2010-177699

(51) Int. Cl.
*H01J 61/30* (2006.01)

(52) U.S. Cl.
USPC ..... 313/113; 313/634

(58) Field of Classification Search
USPC ..... 313/113–118, 634
See application file for complete search history.

(56) References Cited

U.S. PATENT DOCUMENTS

| | | | | |
|---|---|---|---|---|
| 7,439,662 | B2 | 10/2008 | Arndt et al. | |
| 2006/0226754 | A1 | 10/2006 | Arndt et al. | |
| 2008/0261993 | A1 | 10/2008 | Barron et al. | |
| 2009/0085484 | A1 * | 4/2009 | Kakisaka et al. | 313/634 |
| 2009/0316410 | A1 * | 12/2009 | Takeda et al. | 362/263 |
| 2010/0219755 | A1 | 9/2010 | Tonomori et al. | |
| 2010/0253220 | A1 * | 10/2010 | Takeda et al. | 313/634 |

FOREIGN PATENT DOCUMENTS

| | | | |
|---|---|---|---|
| EP | 2 031 634 | | 3/2009 |
| JP | 2007-522606 | | 8/2007 |
| JP | 2008-517939 | | 5/2008 |
| JP | 2009-289524 | | 12/2009 |
| JP | 2009289524 | A * | 12/2009 |
| JP | 4436428 | | 1/2010 |
| JP | 2010-56031 | | 3/2010 |

* cited by examiner

*Primary Examiner* — Anh Mai
*Assistant Examiner* — Brenitra M Lee

(57) ABSTRACT

The present invention aims to provide a metal vapor discharge lamp that has an outer tube less likely to break, and that is obtained at low manufacturing cost. A metal vapor discharge lamp 10 comprises: an outer tube 300 having an open end portion 301 at one end and a closed end portion 302 at another end; an inner tube 200 housed in the outer tube 300; a discharge tube 100 housed in the inner tube 200; and a base 400 attached to the open end portion 301 of the outer tube 300, wherein relationships of $t \geqq 1.1 \times d^{-0.4}$; $0 < d$; and $0.3 \leqq t$ are satisfied, where t denotes a minimum thickness, in millimeters, of the closed end portion 302 of the outer tube 300, d denotes a shortest distance, in millimeters, in a direction of a longitudinal axis of the outer tube 300, between an inner surface 304 of the closed end portion 302 of the outer tube 300 and an outer surface 204 of an end portion 202 of the inner tube 200, the end portion 202 being located opposite from the base 400.

16 Claims, 17 Drawing Sheets

FIG. 4

Power consumption 39 W (Standard mercury content 4.5 mg)

| Sample No. | Shortest distance d [mm] | Minimum thickness t [mm] | No. of broken outer tubes | Evaluation |
|---|---|---|---|---|
| 1 | 0.5 | 1.4 | 0 | Favorable |
| 2 | | 1.3 | 0 | Favorable |
| 3 | | 1.2 | 1 | Faulty |
| 4 | 1.0 | 1.1 | 0 | Favorable |
| 5 | | 1.0 | 0 | Favorable |
| 6 | | 0.9 | 2 | Faulty |
| 7 | 2.0 | 0.8 | 0 | Favorable |
| 8 | | 0.7 | 0 | Favorable |
| 9 | | 0.6 | 2 | Faulty |
| 10 | 4.5 | 0.6 | 0 | Favorable |
| 11 | | 0.5 | 0 | Favorable |
| 12 | | 0.4 | 2 | Faulty |
| 13 | 9.0 | 0.5 | 0 | Favorable |
| 14 | | 0.4 | 0 | Favorable |
| 15 | | 0.3 | 2 | Faulty |

FIG. 5

Power consumption 73 W (Standard mercury content 12.5 mg)

| Sample No. | Shortest distance d [mm] | Minimum thickness t [mm] | No. of broken outer tubes | Evaluation |
|---|---|---|---|---|
| 16 | 0.7 | 1.3 | 0 | Favorable |
| 17 | | 1.2 | 0 | Favorable |
| 18 | | 1.1 | 1 | Faulty |
| 19 | 1.2 | 1.1 | 0 | Favorable |
| 20 | | 1.0 | 0 | Favorable |
| 21 | | 0.9 | 3 | Faulty |
| 22 | 3.0 | 0.8 | 0 | Favorable |
| 23 | | 0.7 | 0 | Favorable |
| 24 | | 0.6 | 3 | Faulty |
| 25 | 7.0 | 0.6 | 0 | Favorable |
| 26 | | 0.5 | 0 | Favorable |
| 27 | | 0.4 | 2 | Faulty |
| 28 | 11.0 | 0.5 | 0 | Favorable |
| 29 | | 0.4 | 0 | Favorable |
| 30 | | 0.3 | 3 | Faulty |

FIG. 8

| Rated power [W] | Mercury content specified in manufacturing standard [mg] | Mercury content [mg] | | | End portion of inner tube has substantially hemispherical shape | | 8.0 mm ≤ R or substantially flat surface | | Remarks |
|---|---|---|---|---|---|---|---|---|---|
| | | | Sample No. 11 | Sample No. 25 | Sample No. 11 | Sample No. 25 | Sample No. 11 | Sample No. 25 | |
| 39 | 4.5±0.5 | 5.0 | 1 | — | 0 | — | 0 | — | Mercury content is max within standard |
| 39 | | 5.5 | 2 | — | 1 | — | 0 | — | Mercury content exceeds max in standard |
| 73 | 12.5±0.5 | 13.0 | — | 2 | — | 0 | — | 0 | Mercury content is max within standard |
| 73 | | 13.5 | — | 3 | — | 3 | — | 0 | Mercury content exceeds max in standard |
| Evaluation | | | △ | △ | ○ | ○ | ◎ | ◎ | |

METAL VAPOR DISCHARGE LAMP AND LIGHTING APPARATUS

TECHNICAL FIELD

The present invention relates to a metal vapor discharge lamp and a lighting apparatus, and in particular to a structure for preventing breakage of an outer tube of a metal halide lamp.

BACKGROUND ART

Conventional metal halide lamps have a triple tube structure as shown in FIG. 24. In FIG. 24, a metal halide lamp 500 includes a discharge tube 501, an inner tube 502, and an outer tube 503. The discharge tube 501 is housed in the inner tube 502, and the inner tube is housed in the outer tube 503. In such a structure, even if the inner tube 502 is broken by rupture of the discharge tube 501, the broken pieces of the discharge tube 501 and the inner tube 502 remain in the outer tube 503. This prevents the broken pieces of the discharge tube 501 and the inner tube 502 from scattering around.

Assume here that when the discharge tube 501 ruptures, a middle portion 504 of the inner tube 502, which is a portion in the vicinity of the discharge tube 501, gets broken. In this case, an end portion 505 of the inner tube 502 may be blown off toward a closed end portion 506 of the outer tube 503. If the end portion 505 is blown off and collides against the closed end portion 506, the outer tube 503 may be broken and the broken pieces thereof may be scattered around.

In order to prevent such breakage of the outer tube 503, the following structure is proposed in Patent Literature 1. That is, a breakage prevention member 507 for preventing breakage of the outer tube 503 is arranged between the end portion 505 of the inner tube 502 and the closed end portion 506 of the outer tube 503. Since the breakage prevention member 507 prevents the end portion 505 of the inner tube 502 from directly colliding against the closed end portion 506 of the outer tube 503, breakage of the outer tube 503 is prevented.

CITATION LIST

Patent Literature

[Patent Literature 1]
Japanese Patent No. 4436428

SUMMARY OF INVENTION

Technical Problem

However, when the breakage prevention member 507 is arranged in the metal halide lamp 500, the manufacturing cost of the metal halide lamp 500 is increased due to an increase in the number of members constituting the metal halide lamp 500 and complication in the assembly work.

The present invention has been achieved in view of the above problem, and an aim thereof is to provide a metal vapor discharge lamp having an outer tube that is less likely to break without a breakage prevention member and a lighting apparatus having the metal vapor discharge lamp.

Solution to Problem

In order to achieve the above aim, the present invention provides a metal vapor discharge lamp comprising: an outer tube having an open end portion at one end and a closed end portion at another end; an inner tube housed in the outer tube; a discharge tube housed in the inner tube; and a base attached to the open end portion of the outer tube, wherein relationships of $t \geqq 1.1 \times d^{-0.4}$; $0<d$; and $0.3 \leqq t$ are satisfied, where t denotes a minimum thickness, in millimeters, of the closed end portion of the outer tube, d denotes a shortest distance, in millimeters, in a direction of a longitudinal axis of the outer tube, between an inner surface of the closed end portion of the outer tube and an outer surface of an end portion of the inner tube, the end portion being located opposite from the base.

The present invention provides a lighting apparatus comprising: the metal vapor discharge lamp described above; and a reflector configured to reflect light emitted from the metal vapor discharge lamp in a desired direction.

Advantageous Effects of Invention

According to the metal vapor discharge lamp and the lighting apparatus of the present invention, the minimum thickness t and the shortest distance d satisfy the relationships of $t \geqq 1.1 \times d^{-0.4}$; $0<d$; and $0.3 \leqq t$. This makes the outer tube less likely to break without the breakage prevention member.

BRIEF DESCRIPTION OF DRAWINGS

FIG. 4 shows a result of safety evaluation regarding a metal vapor discharge lamp having a power consumption of 39 W.

FIG. 5 shows a result of safety evaluation regarding a metal vapor discharge lamp having a power consumption of 73 W.

FIG. 8 is for explaining the effect of the shape of an end portion of an inner tube and a closed end portion of an outer tube on breakage of the outer tube.

DESCRIPTION OF EMBODIMENT

Figure 1:
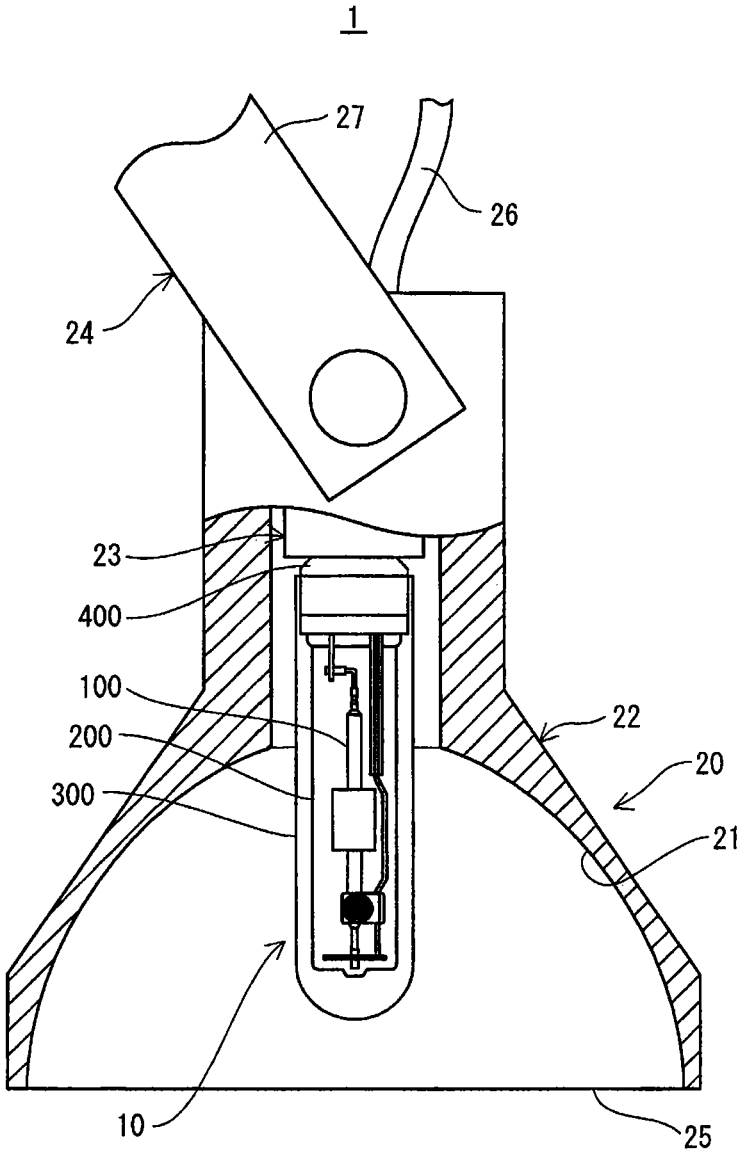
FIG. 1 is a partial cutaway side view showing a lighting apparatus according to one aspect of the present invention.

The following describes a metal vapor discharge lamp and a lighting apparatus according to the present embodiment, with reference to the drawings. Note that the drawings are not to scale, so that proportions of members in the drawings are different from actual proportions.

[Lighting Apparatus]

FIG. 1 is a partial cutaway side view showing a lighting apparatus according to one aspect of the present invention. As shown in FIG. 1, a lighting apparatus 1 according to one aspect of the present invention is a spot lighting apparatus. The lighting apparatus 1 includes a metal vapor discharge lamp 10 (hereinafter, simply "lamp 10") and a lighting fixture 20 in which the lamp 10 is arranged. Note that a lighting apparatus according to the present invention is not limited to a spot lighting apparatus, and may be another lighting apparatus used for other purposes.

The lamp 10 includes a discharge tube 100, an inner tube 200, an outer tube 300, and a base 400. Details of the lamp 10 are described later.

The lighting fixture 20 includes a reflector 22, a socket 23, and a fixing member 24. The reflector 22 has a reflecting surface 21 which is concave and reflects light emitted from the lamp 10 forward. The socket 23 is for attaching the lamp 10 and mounted in the reflector 22. The fixing member 24 is for fixing the reflector 22 to a wall, a ceiling, or the like.

The reflector 22 has an opening 25 from which light exits. The opening 25 is provided at the front end of the reflector 22, and is not covered by a glass plate or the like. In other words, the reflector 22 is of an open type. Accordingly, if the inner tube 200 and the outer tube 300 are broken due to the rupture of the discharge tube 100, the broken pieces of the tubes 100, 200, and 300 may be scattered outside the lighting fixture 20. Suppose here that while the lamp 10 is in operation, the tubes 100, 200, and 300 are broken and the broken pieces thereof are scattered around. In this case, since the broken pieces have a high temperature, they may lead to physical injury or fire. For this reason, it is strongly required that the outer tube 300 of the lamp 10 in the lighting fixture 20 is less likely to break.

The socket 23 is electrically connected, via a supply wire 26, to a lighting appliance (not shown) embedded in a wall or a ceiling. When the base 400 of the lamp 10 is inserted into the socket 23, electric power is supplied from the lighting appliance to the lamp 10.

The fixing member 24 has an arm 27 rotatably attached to a wall or a ceiling. The reflector 22 is pivotally attached to an end of the arm 27. The direction of light emitted from the lighting apparatus 1 is adjustable by rotating the arm 27 or the reflector 22.

[Metal Vapor Discharge Lamp]

Figure 2:
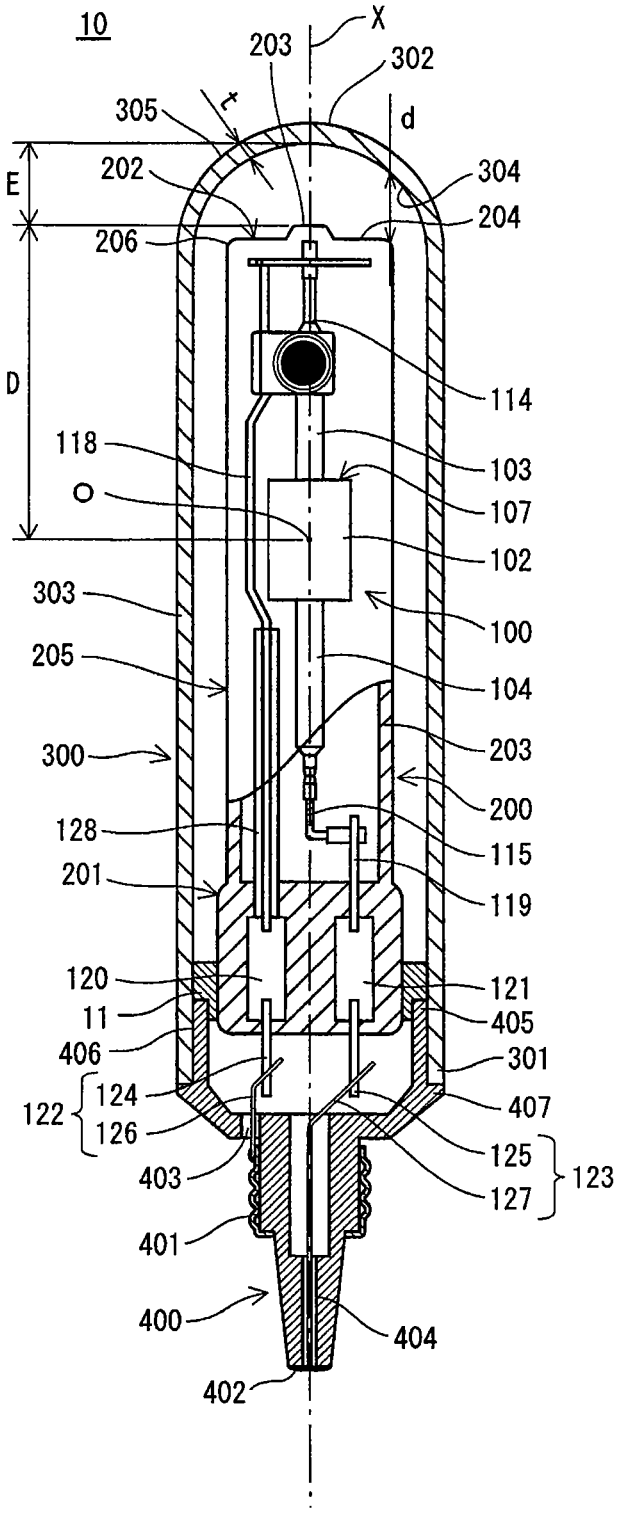
FIG. 2 is a partial cutaway side view showing a metal vapor discharge lamp according to one aspect of the present invention.

FIG. 2 is a partial cutaway side view showing the lamp 10 according to one aspect of the present invention. As shown in FIG. 2, the lamp 10 is a metal halide lamp having a triple tube structure. The outer tube 300 of the lamp 10 has a bottomed cylindrical shape, and has an open end portion 301 at one end and a closed end portion 302 at another end. The inner tube 200 is housed in the outer tube 300. The discharge tube 100 is housed in the inner tube 200. The base 400 is attached to the open end portion 301 of the outer tube 300. It is preferable that the axes of the discharge tube 100, the inner tube 200, and the outer tube 300 substantially coincide with a lamp axis X, which is an axis of the lamp 10 (i.e., central axis of the lamp 10 in the longitudinal direction).

Figure 3:
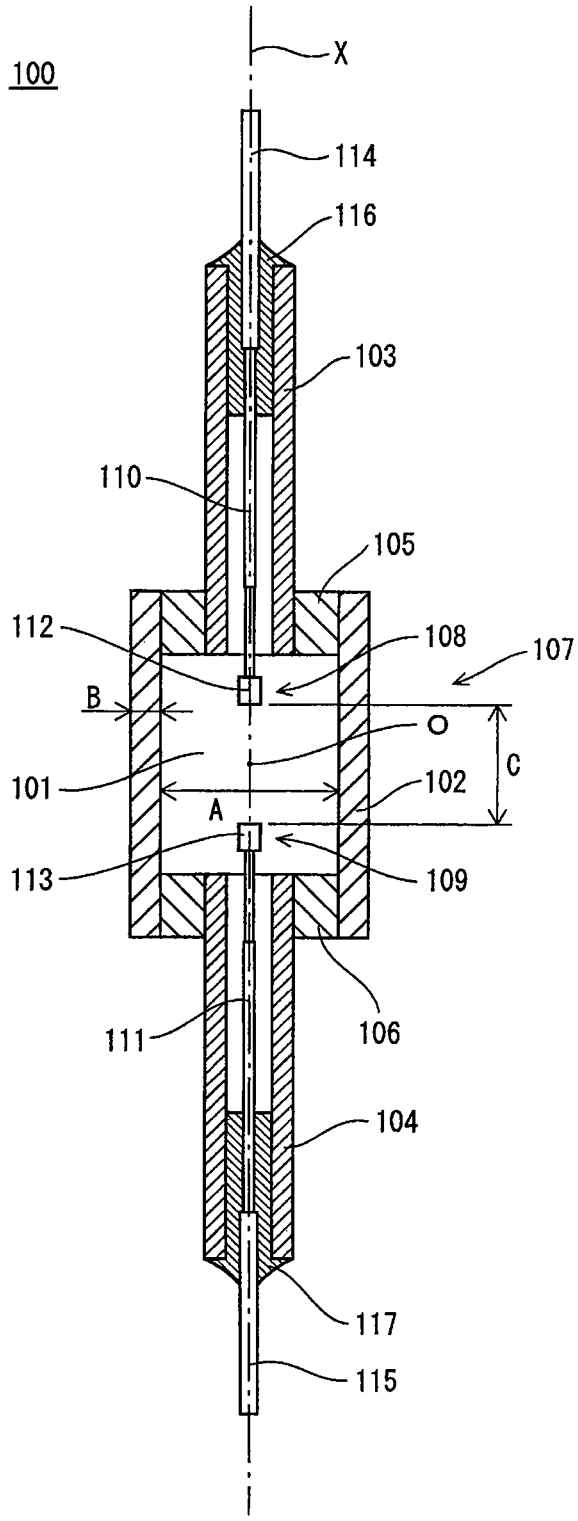
FIG. 3 is a sectional view showing a discharge tube of the metal vapor discharge lamp according to one aspect of the present invention.

FIG. 3 is a sectional view showing the discharge tube 100 of the lamp 10 according to one aspect of the present invention. As shown in FIG. 3, the discharge tube 100 has an envelope 107. The envelope 107 is composed of a main tube 102, narrow tubes 103 and 104, and connecting portions 105 and 106. The main tube 102 is hermetically sealed, and has a discharge space 101 therein. The narrow tubes 103 and 104 extend from the main tube 102 to respective sides of the discharge tube 100 in a direction of the axis of the discharge tube 100 (the direction coincides with the lamp axis X, which is a central axis of the lamp 10 in the longitudinal direction). The connecting portions 105 and 106 have an annular shape. The connecting portion 105 is arranged between the narrow tube 103 and the main tube 102 so as to fill a gap therebetween. The connecting portion 106 is arranged between the narrow tube 104 and the main tube 102 so as to fill a gap therebetween. The envelope 107 is made of alumina ceramic, for example, and is formed by joining three types of members, i.e., the main tube 102, the narrow tubes 103 and 104, and the connecting portions 105 and 106, by shrink fitting.

Note that the envelope 107 does not always need to be made of alumina ceramic, and may be made of other translucent ceramic (e.g., rare earth alumina garnet ceramic), quartz glass, or the like. Also, the envelope 107 does not always need to be formed by joining the aforementioned three types of members by shrink fitting. The envelope 107 may be formed by joining two types of members, i.e., the main tube and the narrow tubes, by shrink fitting. Alternatively, the envelope 107 may be formed by integrally molding the main tube and the narrow tubes. Furthermore, the envelope 107 may be formed by bonding two members. One of the two members is formed by integrally molding one of the narrow tubes and a half of the main tube from its center to one end. The other is formed by integrally molding the other one of the narrow tubes and the other half of the main tube.

The discharge space 101 contains predetermined amounts of a metal halide, a rare gas, and mercury. The metal halide is a luminescent material. The rare gas is used as an auxiliary starting gas. The mercury is used as a buffer gas. Examples of the metal halide include: sodium iodide; dysprosium iodide; holmium iodide; thulium iodide; thallium iodide; cerium iodide; praseodymium iodide; neodymium iodide; calcium iodide; lithium iodide; indium iodide; scandium iodide; or the like. Note that the metal halide for the lamp 10 is determined depending on the choice of the luminescent color of the lamp 10.

The discharge tube 100 has a pair of electrodes 108 and 109. First ends of the electrodes 108 and 109 face each other. A second end of the electrode 108 is inserted into the narrow tube 103, whereas a second end of the electrode 109 is inserted into the narrow tube 104. The central position between the first ends of the electrodes 108 and 109 is a light center O of the discharge tube 100.

The electrodes 108 and 109 respectively include: power feeders 114 and 115; electrode rods 110 and 111; and electrode coils 112 and 113 provided at respective first ends of the electrode rods 110 and 111 (i.e., the ends facing each other in the discharge space 101). The power feeders 114 and 115 are made of a material having a thermal expansion coefficient similar to that of a material constituting the envelope 107. For example, if the envelope 107 is made of alumina ceramic, the power feeders 114 and 115 may be made of a cermet. The electrode rods 110 and 111 are made of a metal having high halogen resistance and a high melting point, such as tungsten. The connection (i) between the power feeder 114 and the electrode rod 110 and (ii) between the power feeder 115 and the electrode rod 111 may be made by welding. Alternatively, in each of the cases (i) and (ii), either the power feeder or the electrode, whichever has a lower melting point, may be welded and thus caused to adhere to the other having a higher melting point. A metal wire having a high halogen resistance, e.g., a molybdenum wire, may be wound around one end of each of the electrode rods 110 and 111 so as to form a coil, each of the ends having the corresponding power feeder.

The electrodes 108 and 109 are preferably arranged along the lamp axis X or an axis parallel to the lamp axis X. Ideally (by design), the electrodes 108 and 109 are preferably arranged along the lamp axis X. In other words, the electrode rods 110 and 111 of the electrodes 108 and 109 are arranged along the lamp axis X. In practice, however, the electrodes 108 and 109 may not be arranged along the axis X, depending on the accuracy of the manufacturing process.

Each of the second ends of the electrode rods 110 and 111 is connected to one end of each of the power feeders 114 and 115 in the narrow tubes 103 and 104. The power feeders 114 and 115 are sealed by sealing materials 116 and 117 composed of frit that is poured into the narrow tubes 103 and 104.

Returning to FIG. 2, the power feeders 114 and 115 are electrically connected to a shell 401 and an eyelet 402, via power supply lines 118 and 119, metal foils 120 and 121, and lead-in wires 122 and 123. The lead-in wire 122 is formed by connecting a first lead wire 124 and a second lead wire 126. The lead-in wire 123 is formed by connecting a first lead wire 125 and a second lead wire 127. The first lead wires 124 and 125 are made of molybdenum, for example, and are connected to the metal foils 120 and 121, respectively. The second lead wires 126 and 127 are made of nickel, for example, and are connected to the base 400. In the above example, the second lead wires 126 and 127 are made of nickel which is a soft metal. This improves the working efficiency of connecting the second lead wires 126 and 127 to the base 400.

Note that a part of the power supply line 118, which faces the power supply line 119 and the power feeder 115 connected thereto, is covered by a sleeve 128. The sleeve 128 is made of quartz glass, for example. This structure achieves the following advantage. Suppose that a leak occurs in the discharge tube 100 at a late stage in the life of the lamp. In this case, a discharge occurs between members that are opposite in polarity, causing an unexpectedly large amount of electric current to constantly flow. This causes problems such as damage to the lighting appliance. However, with the structure using the sleeve 128 as described above, such problems are greatly reduced.

The following describes an example of the dimensions of the discharge tube 100. As shown in FIG. 3, a maximum inner diameter A of the main tube 102 of the discharge tube 100 is (i) in the range of 4.0 mm to 8.0 mm inclusive when the lamp 10 has a rated power of 35 W, and (ii) in the range of 6.0 mm to 10.0 mm inclusive when the lamp 10 has a rated power of 70 W. A maximum thickness B of the main tube 102 is (i) in the range of 0.3 mm to 0.8 mm inclusive when the lamp 10 has a rated power of 35 W, and (ii) in the range of 0.4 mm to 0.9 mm inclusive when the lamp 10 has a rated power of 70 W. An interelectrode distance C, which is a distance between the electrodes 108 and 109, is (i) in the range of 3.0 mm to 7.0 mm inclusive when the lamp 10 has a rated power of 35 W, and (ii) in the range of 5.0 mm to 9.0 mm inclusive when the lamp 10 has a rated power of 70 W. As shown in FIG. 2, a distance D, which is a distance from the light center O of the discharge tube 100 to an end portion 202 of the inner tube 200, is in the range of 20.0 mm to 40.0 mm inclusive regardless of whether the lamp 10 has a rated power of 35 W or 70 W. Note that the aforementioned dimensions are applicable not only when the envelope 107 of the discharge tube 100 is formed by joining the three types of members by shrink fitting as shown in FIG. 3, but also when the envelope 107 is formed: (i) by joining two types of members, i.e., the main tube and the narrow tubes, by shrink fitting; (ii) by integrally molding the main tube and the narrow tubes; or (iii) by bonding two members, one of which is formed by integrally molding one of the narrow tubes and a half of the main tube from its center to one end, and the other by integrally molding the other one of the narrow tubes and the other half of the main tube.

The inner tube 200 is an airtight container having a sealed end, and includes a sealed portion 201 and the end portion 202. The sealed portion 201 is formed by flatly crushing one end of the inner tube 200, which is an end closer to the base 400. The end portion 202 is located at another end of the inner tube 200, which is an end opposite from the base 400 (i.e., an end closer to the top of the lamp 10). The end portion 202 faces the closed end portion 302 of the outer tube 300. Note that the metal foils 120 and 121 are sealed within the sealed portion 201.

The base 400 is of Edison screw type, and includes the shell 401 and the eyelet 402. The second lead wire 126 passes through a through-hole 403 of the base 400 to the outside, and is bonded to the shell 401. The second lead wire 127 passes through a through-hole 404 of the base 400, and is bonded to the eyelet 402.

An end portion 405 of the base 400 on the side of the outer tube 300 is inserted into the open end portion 301 of the outer tube 300. With the stated structure, the outer diameter of the lamp 10 at a portion corresponding to the end portion 405 of the base 400 does not exceed the outer diameter of the outer tube 300. This avoids unnecessarily increasing the diameter of an opening of a neck portion of the reflector 22 of the lighting fixture 20, thus improving the reflection efficiency of the lighting fixture 20.

The base 400 has a flange 407 having an annular shape. The flange 407 is formed on an outer circumferential surface 406 of the base 400, along the circumferential direction thereof. The flange 407 extends outwardly from the outer circumferential surface 406 of the base 400, in a direction perpendicular to the lamp axis X. The flange 407 extends by a distance equivalent to the thickness of the open end portion 301 of the outer tube 300. The flange 407 makes contact with the open end portion 301 of the outer tube 300. This makes it easy to position the base 400 and the outer tube 300 in the direction of the lamp axis X.

The open end portion 301 of the outer tube 300 is firmly fixed to at least one of the outer circumferential surface 406 and the flange 407 of the base 400.

As a means of the aforementioned fixing, an adhesive such as cement may be provided between the open end portion 301 of the outer tube 300 and the outer circumferential surface 406 of the base 400 or between the open end portion 301 of the outer tube 300 and the flange 407 of the base 400. Specific examples of the adhesive include an inorganic adhesive, such as Sumiceram™ manufactured by Asahi Chemical Co., Ltd or Bond X™ manufactured by Nissan Chemical Industries, Ltd. Alternatively, it is possible to provide an engaging structure using a protrusion and a recess. Specifically, a protrusion (or a recess) may be provided for the open end portion 301 of the outer tube 300. Also, a recess (or a protrusion) may be provided on a part of a side surface of the base 400 that makes contact with the open end portion 301. Then, the protrusion may be fit into the recess to form the engaging structure. Also, it is possible to employ both the adhesive and the engagement structure. As another alternative, it is possible to provide a fixing member for the base 400, as described in Modification 7 below. The fixing member mechanically fixes the open end portion 301 of the outer tube 300 to the flange 407.

The sealed portion 201 of the inner tube 200 is fixed to the base 400 by an adhesive 11, whereby the inner tube 200 is supported by the base 400. The adhesive 11 is, for example, cement. The sealed portion 201 of the inner tube 200 is fixed to the outer tube 300 by the adhesive 11, whereby the inner tube 200 is also supported by the outer tube 300.

Returning to FIG. 2, the end portion 202 has a tip-off portion 203, which is a remnant of an exhaust tube used when the inner tube 200 was vacuum pumped. By vacuum pumping the inner tube 200, metal members such as the power feeders 114 and 115 and the power supply lines 118 and 119 are prevented from being exposed to a high temperature and oxidized. Note that instead of vacuum pumping the inner tube 200, the inner tube may be filled with an inert gas to prevent oxidation of the metal members.

It is preferable that the end portion 202, except for the tip-off portion 203 which inevitably has a large curvature, has a substantially hemispherical shape. The reason why a substantially hemispherical shape is preferable is described later. Suppose that the end portion 202 has a substantially hemispherical shape. In this case, the outer diameter of a middle portion 205 of the inner tube 200 is preferably in the range of 13 mm to 17 mm inclusive, and the thickness of the middle portion 205 of the inner tube 200 is preferably in the range of 1 mm to 2 mm inclusive. In order to obtain the lamp 10 having the outer tube 300 that is less likely to break, the radius of curvature r (r being in millimeters) of an outer surface of a shoulder portion 206 of the inner tube 200 is preferably in the range of $2.0 \leqq r \leqq 9.0$. Here, the shoulder portion 206 of the inner tube 200 is a portion of an outer surface 204 of the end portion 202, excluding the tip-off portion 203, and has a large curvature. The radius of curvature r is more preferably in the range of $3.0 \leqq r \leqq 9.0$, and even more preferably in the range of $5.0 \leqq r \leqq 9.0$. This is because of the following reason. Suppose that the outer surface of the shoulder portion 206 of the end portion 202 has a small radius of curvature r, namely, that the roundness of the shoulder portion 206 of the end portion 202 of the inner tube 200 is small, and the end portion 202 has a large curvature. In this case, the yield rate in the manufacturing process significantly decreases, resulting in a rise in cost. On the other hand, suppose that the end portion 202, including the shoulder portion 206, has a substantially hemispherical shape and does not have a large curvature. This suppresses deformation caused during a process for changing the shape of a material constituting the inner tube 200, which makes it possible to provide the inner tube 200 that is robust. For this reason, it is preferable that the end portion 202, including the shoulder portion 206, has a substantially hemispherical shape.

Regarding the inner tube 200, the middle portion 205 between the sealed portion 201 and the end portion 202 has a substantially cylindrical shape, for example. The envelope 107 of the discharge tube 100 is arranged in the middle portion 205 of the inner tube 200. In the case where the discharge tube 100 ruptures, the middle portion 205 of the inner tube 200 generally gets broken due to the rupture. Note that the shape of the middle portion 205 is not limited to a substantially cylindrical shape. For example, the middle portion 205 may have a non-cylindrical tubular shape. Examples of such include a polygonal tubular shape, an oval tubular shape, etc. Also, the inner diameter and outer diameter of the middle portion 205 may not be uniform along the direction of the central longitudinal axis of the inner tube 200. For example, the inner diameter and outer diameter of the middle portion 205 may be larger in an area corresponding to the main tube 102 of the discharge tube 100 than in other areas. In other words, the middle portion 205 may have a bulge.

The inner tube 200 is made of quartz glass, for example. Note that the inner tube 200 does not always need to be made of quartz glass. Instead, the inner tube 200 may be made of a translucent ceramic (e.g., alumina ceramic), hard glass, or the like.

The outer tube 300 has a bottomed cylindrical shape, and is composed of the open end portion (neck portion) 301, the closed end portion 302, and a middle portion 303. The open end portion 301 is located at one end of the outer tube 300 on the side of the base 400. The closed end portion 302 is located at another end of the outer tube 300 opposite from the base 400. The middle portion 303 is located between the open end portion 301 and the closed end portion 302. In the case where the inner tube 200 gets broken due to rupture of the discharge tube 100, the outer tube 300 prevents broken pieces of the discharge tube 100 and the inner tube 200 from scattering around.

The base 400 is attached to the open end portion 301 of the outer tube 300, with use of the adhesive 11. Note that it is not always necessary to use the adhesive 11 to attach the base 400 to the open end portion 301 of the outer tube 300. Instead, the base 400 and the open end portion 301 may have an engaging structure. Specifically, the open end portion 301 and the base 400 may be provided with respective engaging members (e.g., a protrusion may be provided on an inner surface 304 of the outer tube 300, and a recess may be provided on the outer circumferential surface 406 of the base 400). Then, the engaging members may be engaged with each other so that the open end portion 301 is directly attached to the base 400. Alternatively, the base 400 may be provided with a holder (not shown) so as to be engaged with the outer tube 300. Furthermore, the base 400 may be provided with an elastic metal member (not shown), such as a clip, for holding the outer tube 300. With such a structure as described above, the outer tube 300 is prevented from falling. Note that it is also possible to employ a structure where the outer tube 300 is not engaged with the base 400, but instead is bonded with the inner tube 200 using the adhesive 11.

It is preferable that the closed end portion 302 of the outer tube 300 has a substantially hemispherical shape or a plate-like shape. In the case where the closed end portion 302 has a substantially hemispherical shape, the radius of curvature R of the inner surface 304 of the closed end portion 302 is preferably 8.0 mm or larger. In the case where the closed end portion 302 is substantially in a plate-like shape, the inner surface 304 of the closed end portion 302 is preferably flat. The reasons why the aforementioned conditions are preferable are described later.

The following clearly specifies a boundary between the closed end portion 302 and the middle portion 303 so as to clarify which portion of the outer tube 300 corresponds to the closed end portion 302. Between the discharge tube 100 and the closed end portion 302, specifically in the vicinity of the boundary between the middle portion 303 and the closed end portion 302, a portion of the outer tube 300 having an approximately equal inner diameter, which is measured in a direction perpendicular to the lamp axis X, belongs to the middle portion 303. Meanwhile, the boundary between the middle portion 303 and the closed end portion 302 is where the envelope 107 is not present in a cross section perpendicular to the lamp axis X and where the inner diameter of the outer tube 300 starts becoming smaller. The closed end portion 302 is a portion closer to the top of the lamp than the boundary. In the case where the closed end portion 302 has a substantially hemispherical shape, the closed end portion 302 is where the inner diameter of the outer tube 300 becomes smaller toward the top of the lamp. In the case where the closed end portion 302 is substantially in a plate-like shape, the closed end portion 302 is a substantially plate-like portion of the outer tube 300 and the rim of the substantially plate-like portion.

To ensure the compactness of the lamp 10 and the compatibility with the lighting fixture 20, the middle portion 303 preferably has a maximum outer diameter in the range of 16 mm to 27 mm inclusive, a neck diameter (i.e., diameter near the sealed portion 201) in the range of 16 mm to 23 mm inclusive, and a thickness in the range of 1 mm to 2 mm inclusive.

In particular, as shown in FIG. 2, in the case of the lamp 10 having the outer tube 300 whose outer diameter is uniform at the middle portion 303 and the open end portion (neck portion) 301, the outer diameter of the middle portion 303 is preferably in the range of 16 mm to 22 mm inclusive. This ensures that the lamp 10 is slim, elegant and compact. In this case, the middle portion 303 preferably has an inner diameter in the range of 13 mm to 17 mm inclusive, and a thickness in the range of 1.0 mm to 2.0 mm inclusive.

To ensure the compactness of the lamp 10, the middle portion 303 preferably has a substantially cylindrical shape, in the same manner as the middle portion 205 of the inner tube 200. Also, it is preferable that the gap between the inner surface of the middle portion 303 of the outer tube 300 and the outer surface of the middle portion 205 of the inner tube 200 is substantially uniform in a direction perpendicular to the lamp axis X.

Note that the shape of the middle portion 303 is not limited to a substantially cylindrical shape. For example, the middle portion 303 may have a non-cylindrical tubular shape. Examples of such include a polygonal tubular shape, an oval tubular shape, etc.

To ensure a clearance for covering the inner tube 200 with the outer tube 300 in the assembly process, the gap between the inner surface of the middle portion 303 of the outer tube 300 and the outer surface of the middle portion 205 of the inner tube 200 is preferably, on average, in the range of 1 mm to 3 mm inclusive in an area corresponding to a straight portion of the middle portion 303 and, on average, in the range of 1 mm to 5 mm in an area corresponding to a bulge 306 of the middle portion 303.

The outer tube 300 is made of hard glass, for example. Note that the outer tube 300 does not always need to be made of hard glass. Instead, the outer tube 300 may be made of a translucent ceramic (e.g., alumina ceramic), quartz glass, or the like.

Given that: t (t being in millimeters) denotes the minimum thickness of the closed end portion 302 of the outer tube 300; and d (d being in millimeters) denotes the shortest distance between the inner surface 304 of the closed end portion 302 of the outer tube 300 and the outer surface 204 of the end portion 202 of the inner tube 200 in a direction of the longitudinal axis of the outer tube 300, the following relationships are satisfied: $t \geqq 1.1 \times d^{-0.4}$; $0 < d$; and $0.3 \leqq t$.

Suppose that the inner tube 200 is broken by rupture of the discharge tube 100, and the broken pieces of the discharge tube 100 and the inner tube 200 are scattered toward the closed end portion 302 of the outer tube 300. In this case, immediately after the breakage, the diffusion velocity of a filler gas is greater than the velocity of the broken pieces. Therefore, the filler gas reaches the outer tube 300 faster than the broken pieces, and the scattered broken pieces are pushed back by the filler gas bounced back from the inner surface 304 of the outer tube 300. As a result, the velocity of the broken pieces is reduced. Accordingly, when the shortest distance d is small, the velocity of the broken pieces is not reduced significantly before the broken pieces reach the outer tube 300. As a result, the broken pieces give a strong impact on the outer tube 300, and are thereby likely to break the outer tube 300. At this point, if the thickness of the closed end portion 302 is large, the closed end portion 302 becomes highly resistant to impact and less likely to break. The thickness of the closed end portion 302 refers to a width between the inner surface 304 of the outer tube 300 and an outer surface 305 thereof, in a normal direction with respect to the inner surface 304. The value of the thickness of the closed end portion 302 is obtained by measurement using an X-ray or by measurement of the cross section of the outer tube 300 using vernier calipers or the like.

Regarding the lower limit of the thickness of the closed end portion 302 of the outer tube 300, if the minimum thickness t is small, the working of the outer tube 300 becomes difficult, and the outer tube 300 having a desired shape cannot be obtained. Furthermore, the outer tube may break due to impact during transportation or at the time of attaching the lamp to the lighting fixture. Accordingly, the minimum thickness t is preferably 0.3 mm or larger. Furthermore, it is difficult to manufacture the closed end portion 302 having a minimum thickness of 1.0 mm or smaller. Therefore, it is preferable that the minimum thickness t is 1.1 mm or larger.

Meanwhile, regarding the upper limit of the thickness of the closed end portion 302 of the outer tube 300, the minimum thickness t is preferably 5.0 mm or smaller in view of the integration with the middle portion 303 and the ease of working. Furthermore, if the minimum thickness t is large, it is difficult to work the closed end portion 302 of the outer tube 300 into a substantially hemispherical shape or substantially plate-like shape. Therefore, the minimum thickness t is preferably 3.0 mm or smaller in view of the workability of the closed end portion 302 and the integration of the closed end portion 302 with the middle portion 303.

The shortest distance d is preferably 15 mm or smaller. If the shortest distance d exceeds 15 mm, it is difficult to appropriately maintain the posture of the inner tube 200 with respect to the outer tube 300. In other words, it is difficult to adjust the position of the inner tube 200 with respect to the outer tube 300, such that the axis of the outer tube 300 is parallel to the axis of the inner tube 200.

As shown in FIG. 2, the shortest distance d in the present embodiment is a distance between the shoulder portion 206 of the end portion 202 of the inner tube 200 and the inner surface 304 of the closed end portion 302 of the outer tube 300 in a direction of the lamp axis X. However, the shortest distance d is not limited to such. For example, suppose that a distance E, which is a distance between the tip-off portion 203 of the inner tube 200 and the closed end portion 302 of the outer tube 300 in the direction of the lamp axis X, is shorter than the distance between the shoulder portion 206 of the end portion 202 of the inner tube 200 and the inner surface 304 of the closed end portion 302 of the outer tube 300 in the direction of the lamp axis X. In this case, the distance E can be the shortest distance d.

If the minimum thickness t and the shortest distance d satisfy the above relationships (i.e., $t \geqq 1.1 \times d^{-0.4}$; $0<d$; and $0.3 \leqq t$), breakage of the outer tube 300 is prevented without the breakage prevention member recited in Patent Literature 1. The above relationships were discovered through safety evaluation as shown below, which was conducted using a lamp having a rated power of 35 W and a lamp having a rated power of 70 W.

First, lamps of samples No. 1 to No. 15, four lamps per each sample, are prepared as lamps having a rated power of 35 W. Then, based on the examination of UL standard No. 1572 (Underwriters Laboratories Inc./UL standard No. 1572/the title of the standard: High Intensity Discharge Lighting Fixtures, 1991 edition), safety of each lamp at the time of breakage of its discharge tube was evaluated. Specifically, each lamp was stably lit for 15 minutes. Then, for each lamp, a circuit is shorted so as to apply a high current to the lamp and cause the discharge tube to break. If none of the outer tubes of the four lamps in a sample is cracked, the lamps belonging to the sample were evaluated as "favorable". If any of the outer tubes of the four lamps in a sample is cracked, the lamps belonging to the sample were evaluated as "faulty".

Also, lamps of samples No. 16 to No. 30, four lamps per each sample, are prepared as lamps having a rated power of 70 W. Then, in the same manner as in the lamps having a rated power of 35 W, safety of each lamp at the time of breakage of its discharge tube was evaluated.

Here, a lamp having a rated power of 35 W has a power consumption in the range of 30 W to 45 W inclusive, an arc length (i.e., distance between the electrodes 108 and 109) in the range of 2.5 mm to 5.5 mm inclusive, and a mercury content in the range of 3.0 mg to 4.5 mg inclusive. In the safety evaluation, lamps having the following features were used as an example of lamps having a rated power of 35 W. That is, the lamps have a power consumption of 39 W; an arc length of 4.5 mm; and a mercury content of 4.5 mg. Also, the maximum outer diameter of both the middle portion and the open end portion of each outer tube is 21 mm, and the thickness of both the middle portion and the open end portion of each outer tube is 1.5 mm.

Also, a lamp having a rated power of 70 W has a power consumption in the range of 65 W to 80 W inclusive, an arc length in the range of 5.5 mm to 8.0 mm inclusive, and a mercury content in the range of 9.0 mg to 12.5 mg inclusive. In the safety evaluation, lamps having the following features were used as an example of lamps having a rated power of 70 W. That is, the lamps have a power consumption of 73 W; an arc length of 6.0 mm; and a mercury content of 12.5 mg. Also, the maximum outer diameter of both the middle portion and the open end portion of each outer tube is 22 mm, and the thickness of both the middle portion and the open end portion of each outer tube is 1.5 mm.

FIG. 4 shows a result of safety evaluation regarding a metal vapor discharge lamp having a power consumption of 39 W. FIG. 5 shows a result of safety evaluation regarding a metal vapor discharge lamp having a power consumption of 73 W.

As shown in FIG. 4, the safety evaluation regarding a lamp having a power consumption of 39 W resulted as "favorable" in the following cases: the shortest distance d is 0.5 mm and the minimum thickness t is 1.3 mm or larger (see sample No. 2); the shortest distance d is 1.0 mm and the minimum thickness t is 1.0 mm or larger (sample No. 5); the shortest distance d is 2.0 mm and the minimum thickness t is 0.7 mm or larger (sample No. 8); the shortest distance d is 4.5 mm and the minimum thickness t is 0.5 mm or larger (sample No. 11); and the shortest distance d is 9.0 mm and the minimum thickness t is 0.4 mm or larger (sample No. 14). Note that the evaluation result shown in FIG. 4 pertains to a lamp having a power consumption of 39 W. However, the same result was obtained in the case of lamps having a rated power of 35 W having a power consumption, an arc length, and a mercury content that fall within the aforementioned respective ranges.

Also, as shown in FIG. 5, the safety evaluation regarding a lamp having a power consumption of 73 W resulted as "favorable" in the following cases: the shortest distance d is 0.7 mm and the minimum thickness t is 1.2 mm or larger (see sample No. 17); the shortest distance d is 1.2 mm and the minimum thickness t is 1.0 mm or larger (sample No. 20); the shortest distance d is 3.0 mm and the minimum thickness t is 0.7 mm or larger (sample No. 23); the shortest distance d is 7.0 mm and the minimum thickness t is 0.5 mm or larger (sample No. 26); and the shortest distance d is 11.0 mm and the minimum thickness t is 0.4 mm or larger (sample No. 29). Note that the evaluation result shown in FIG. 5 pertains to a lamp having a power consumption of 73 W. However, the same result was obtained in the case of lamps having a rated power of 70 W having a power consumption, an arc length, and a mercury content that fall within the aforementioned respective ranges.

Figure 6:
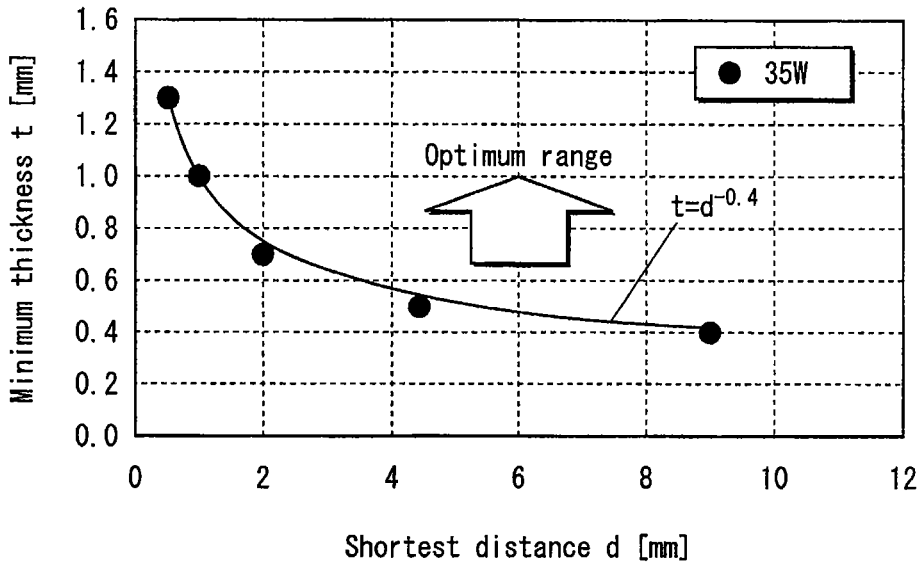
FIG. 6 is for explaining conditions for reducing the probability of breakage of an outer tube of a metal vapor discharge lamp having a rated power of 35 W.

FIG. 6 is for explaining conditions for reducing the probability of breakage of an outer tube of a metal vapor discharge lamp having a rated power of 35 W. Regarding lamps having a rated power of 35 W, the values of the samples No. 2, No. 5, No. 8, No. 11 and No. 14 were plotted on Cartesian coordinates where the horizontal axis represents the shortest distance d and the vertical axis represents the minimum thickness t. As a result, a regression curve expressed by $t \geqq d^{-0.4}$ was obtained.

Figure 7:
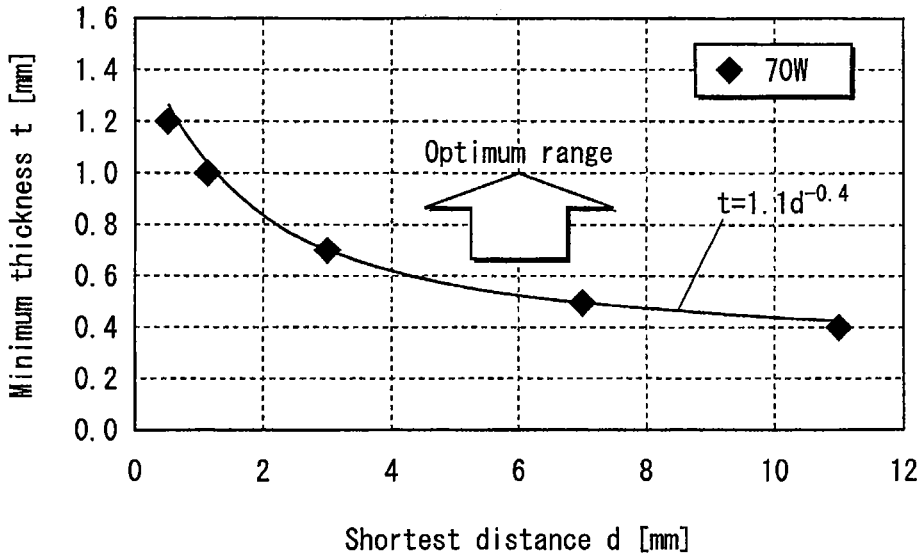
FIG. 7 is for explaining conditions for reducing the probability of breakage of an outer tube of a metal vapor discharge lamp having a rated power of 70 W.

FIG. 7 is for explaining conditions for reducing the probability of breakage of an outer tube of a metal vapor discharge lamp having a rated power of 70 W. Similarly, regarding lamps having a rated power of 70 W, the values of the samples No. 17, No. 20, No. 23, No. 26, and No. 29 were plotted. As a result, a regression curve expressed by $t \geqq 1.1 \times d^{-0.4}$ was obtained.

Based on the above result, it was found that breakage of the outer tube does not occur as long as the values of the shortest distance d and the minimum thickness t fall within an area on and above the regression curve expressed by $t \geqq 1.1 \times d^{-0.4}$. Furthermore, the regression curve for the lamps having a rated power of 35 W substantially matches the regression curve for the lamps having a rated power of 70 W. Accordingly, it was found that rated power has little effect on the relationships between the shortest distance d and the minimum thickness t.

Within the range of rated power in the present embodiment, a difference in power consumption when the lamp is stably lit, a difference in arc length, and a difference in mercury content have little effect on breakage of the discharge tube. This is because breakage of the discharge tube is caused when a pressure inside the arc tube suddenly rises and exceeds a threshold for maintaining the structure of the discharge tube. Such a sudden rise in pressure is caused by an instantaneous increase in a current flowing through the arc tube due to shorting of the circuit after the lamp is stably lit. Accordingly, whether the outer tube gets broken is mainly determined by the material, dimensions, and shape of the inner tube and the material, dimensions, and shape of the outer tube, rather than a power consumption when the lamp is stably lit, an arc length, and a mercury content.

Note that the evaluation results described above are obtained when the outer tube 300 is made of hard glass. However, these evaluation results are also valid at least in the case where the outer tube 300 is made of quartz glass or alumina ceramic. This is because the Young's modulus of quartz glass is substantially the same as that of hard glass, and the Young's modulus of alumina ceramic is larger than that of hard glass.

Young's modulus is the ratio of stress to strain. The larger the Young's modulus is, the more difficult it becomes for the material to absorb impact by elastic deformation. For this reason, if the outer tube 300 is made of quartz glass, which has substantially the same Young's modulus as hard glass, a result of the safety evaluation is assumed to be the same as the case where the outer tube 300 is made of hard glass. Also, if the outer tube 300 is made of alumina ceramic, which has a larger Young's modulus than hard glass, safety is assumed to be higher than the case where the outer tube 300 is made of hard glass.

Note that the evaluation results described above are obtained when the inner tube 200 is made of quartz glass. However, these evaluation results are also valid at least in the case where the inner tube 200 is made of hard glass or alumina ceramic. This is because the density of hard glass is approximately 2.2 g/cm$^3$, which is the same as the density of quartz glass, and the density of alumina ceramic is approximately 3.6 g/cm$^3$, which is larger than the density of quartz glass.

Assume here that when the discharge tube 100 ruptures, a portion of the inner tube 200 in the vicinity of the discharge tube 100 gets broken. In this case, broken pieces of the inner tube 200 (end portion 202 of the inner tube 202) may be blown off toward the closed end portion 302 of the outer tube 300. The inventors have found from the safety evaluation that the sizes of broken pieces are substantially the same, regardless of a material that constitutes the inner tube 200. The impulse on broken pieces given by rupture of the discharge tube 100 is expressed by the product of the force f generated by the rupture and the time Δt during which the force is received. The impulse is given to the broken pieces as a momentum which is the product of the mass m and velocity v of the broken pieces. In other words, the velocity v of broken pieces is proportional to the force f generated by rupture and the time Δt during which the force is received, and is inversely proportional to the mass of broken pieces. Specifically, the force f generated by rupture is calculated by integrating the pressure applied by the rupture over the inner surfaces of the broken pieces. Since the sizes of the broken pieces are not determined by a material constituting the inner tube 200, the force f generated by rupture is also not determined by the material constituting the inner tube 200. Also, the time Δt during which the force f is received is mainly determined by the propagation of a gas flow, which is generated by the rupture of the discharge tube 100. Therefore, although the time Δt is estimated to be substantially the same at least in the case where the inner tube 200 is made of hard glass, quartz glass, or alumina ceramic, as seen in the present embodiment, the time Δt may differ if the inner tube 200 is made of a material different from those mentioned above. Based on these respects, it is considered that the momentum given to the broken pieces of the inner tube 200 is not determined by a material constituting the inner tube 200. Meanwhile, the mass m of broken pieces increases in proportion to the density of a material constituting the inner tube. Accordingly, the velocity of the broken pieces is smaller when the inner tube 200 is made of alumina ceramic than when the inner tube 200 is made of quartz glass, since alumina ceramic has a larger density than quartz glass. This means that the time that elapses before the broken pieces reach the outer tube 300 is longer when the inner tube 200 is made of alumina ceramic. Here, when the discharge tube 100 ruptures, the filler gas inside the ruptured discharge tube 100 reaches the outer tube 300 faster than the broken pieces. Accordingly, the broken pieces are pushed back by the filler gas bounced back from the inner surface 304 of the outer tube 300, whereby the velocity of the broken pieces is reduced. For this reason, it is estimated that the safety is higher when the inner tube 200 is made of alumina ceramic than when the inner tube 200 is made of quartz glass. Also, it is estimated that the velocity of the broken pieces is substantially the same between the case where the inner tube 200 is made of quartz glass and the case where the inner tube 200 is made of hard glass, since hard glass and quartz glass have the same density. Accordingly, a result of the safety evaluation will presumably be the same in both cases.

Note that the sizes of broken pieces are substantially the same between the lamps having a rated power of 35 W and the lamps having a rated power of 70 W. Accordingly, a result of the safety evaluation will presumably the same between the lamps having a rated power of 35 W and the lamps having a rated power of 70 W.

The following describes a result of a study on the effect of the shape of an end portion of an inner tube and a closed end portion of an outer tube on breakage of the outer tube. FIG. 8 is for explaining the effect of the shape of an end portion of an inner tube and a closed end portion of an outer tube on breakage of the outer tube.

As shown in FIG. 8, safety evaluation was conducted on the lamps belonging to sample No. 11, which are the lamps having a rated power of 35 W. In this safety evaluation, the mercury content of each lamp in sample No. 11 is increased from 4.5 mg to 5.0 mg. As a result, the number of broken outer tubes increased from 0 (zero) out of 4 to 1 out of 4. Further, the mercury content was increased from 4.5 mg to 5.5 mg. As a result, the number of broken outer tubes increased to 2 out of 4. Also, safety evaluation was conducted on the lamps belonging to sample No. 25, which are the lamps having a rated power of 70 W. In this safety evaluation, the mercury content of each lamp in sample No. 25 is increased from 12.5 mg to 13.0 mg. As a result, the number of broken outer tubes increased from 0 (zero) out of 4 to 2 out of 4. Further, the mercury content was increased from 12.5 mg to 13.5 mg. As a result, the number of broken outer tubes increased to 3 out of 4.

Here, regarding sample No. 11, the shape of each tip-off portion was unchanged, whereas the shape of the end portion of each inner tube was changed from a substantially plate-like shape as shown in FIG. 2 to a substantially hemispherical shape. As a result, although the mercury content was 5.0 mg, the number of broken outer tubes was 0 (zero) out of 4, making the outer tubes less likely to break. However, in the case where the mercury content was 5.5 mg, 1 out of 4 outer tubes broke although the shape of the end portion of each inner tube was changed to a substantially hemispherical shape. Also, regarding sample No. 25, the shape of the end portion of each inner tube was changed to a substantially hemispherical shape. As a result, although the mercury content was 13.0 mg, the number of broken outer tubes was 0 (zero) out of 4, making the outer tubes less likely to break. However, in the case where the mercury content was 13.5 mg, 3 out of 4 outer tubes broke although the shape of the end portion of each inner tube was changed to a substantially hemispherical shape.

Next, regarding samples No. 11 and No. 25, the inner surface of the closed end portion of each outer tube was changed from a curved surface having a radius of curvature R of less than 8.0 mm to a curved surface having a radius of curvature R of 8.0 mm or larger or a substantially flat surface. Also, the shape of each tip-off portion was unchanged, whereas the shape of the end portion of each inner tube was changed to a substantially hemispherical shape. As a result, regarding sample No. 11, the number of broken outer tubes was 0 (zero) out of 4 in both cases where the mercury content was 5.0 mg and where the mercury content was 5.5 mg, making the outer tubes even less likely to break. Also, regarding sample No. 25, the number of broken outer tubes was 0 (zero) out of 4 in both cases where the mercury content was 13.0 mg and where the mercury content was 13.5 mg, making the outer tubes even less likely to break.

When the end portion 202 of the inner tube 200 has a substantially hemispherical shape, or when the inner surface 304 of the closed end portion 302 of the outer tube 300 is curved with a radius of curvature R of 8.0 mm or larger or has a substantially flat surface, a distance between the shoulder portion 206 of the end portion 202 of the inner tube 200 and the inner surface 304 of the closed end portion 302 of the outer tube 300 in the direction of the lamp axis X is longer. It is considered that the distance between the shoulder portion 206 and the inner surface 304 is the shortest distance d, meaning that the shortest distance d is longer, and as a result, the outer tube 300 has become even less likely to break. Also, when the inner surface 304 of the closed end portion 302 of the outer tube 300 is curved with a radius of curvature R of 8.0 mm or larger or has a substantially flat surface, the deformation of the closed end portion 302 of the outer tube 300 is smaller. It is considered that this also contributes to the outer tube 300 being less likely to break.

While details of the metal vapor discharge lamp and the lighting apparatus according to the present invention have been described based on the above embodiment, the metal vapor discharge lamp and the lighting apparatus according to the present invention are not limited to the above embodiment. For example, the following modifications are possible. In the following modifications, the same components as the above embodiment are given the same reference signs as in the above embodiment, and descriptions of such components are omitted.

(Modification 1)

Figure 9:
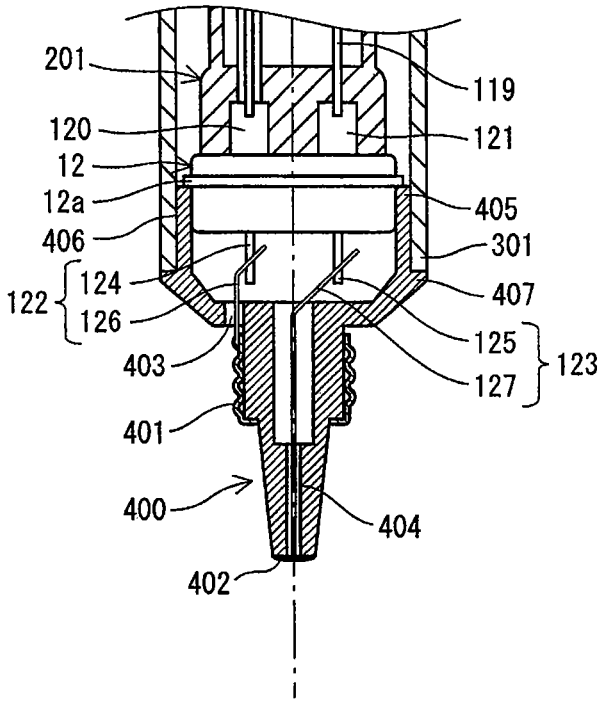
FIG. 9 is for explaining a metal vapor discharge lamp according to Modification 1.

For example, the inner tube 200 may be supported by a holder 12 holding the sealed portion 201. Specifically, the holder 12 is provided for the end portion 405 of the base 400 on the side of the outer tube 300, and holds the inner tube 200, as shown in FIG. 9. The holder 12 is a part of the base 400. The holder 12 is provided with a slot (not shown) that corresponds to the shape of the sealed portion 201. The tip of the sealed portion 201 is inserted into the slot, whereby the sealed portion 201 is held by the base 400.

In this case, the sealed portion 201 may be fixed to the holder 12 before the holder 12 is fixed to the base 400. In this way, fixing of the sealed portion 201 can be performed separately from fixing of the second lead wires 126 and 127 of the inner tube 200 to the base 400. This makes it easier to assemble the lamp. The holder 12 has a large diameter portion 12*a* which is flanged. The large diameter portion 12*a* is arranged at an outer circumferential surface of the holder 12 and engaged with the end portion 405 of the base 400 on the side of the outer tube 300. Note that the outer tube 300 may be fixed to the holder 12 by, for example, placing the open end portion 301 of the outer tube 300 in contact with a surface of the large diameter portion 12*a* located opposite from the base 400 (i.e., a surface closer to the top of the lamp).

(Modification 2)

Figure 10:
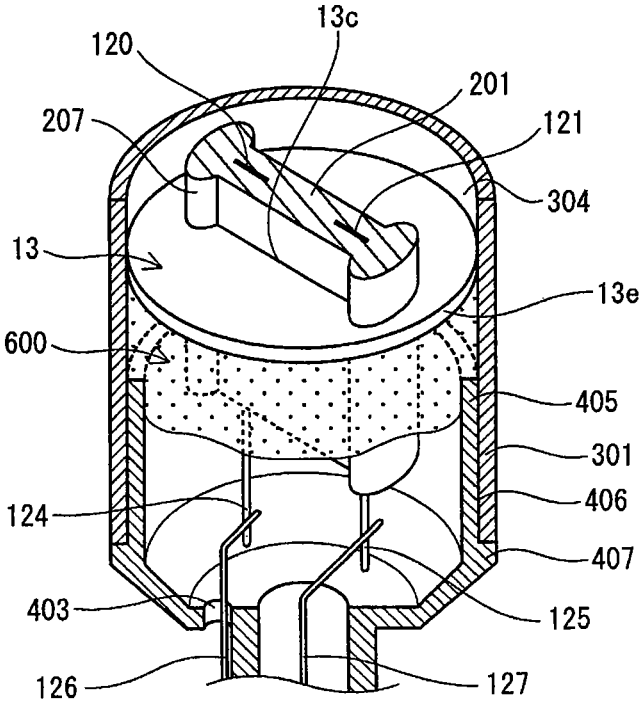
FIG. 10 is for explaining a metal vapor discharge lamp according to Modification 2.

Also, as shown in FIG. 10, the sealed portion 201 of the inner tube 200 may be supported by a flanged member 13 provided between the sealed portion 201 and the outer tube 300. The flanged member 13 fits around the sealed portion 201 of the inner tube 200.

The base 400 is circumscribed by the open end portion 301 of the outer tube 300. In this way, during a process of filling a gap between the inner tube and the outer tube with an adhesive, such as cement, a degree at which the adhesive is filled can be externally checked without using a special jig.

An adhesive 600 is provided for a portion of the flanged member 13 on the side of the base 400. For example, a main surface 13*a* of the flanged member 13 on the side of the base 400 is covered by the adhesive 600, whereby the main surface 13*a* cannot be seen from outside the lamp 10. On the other hand, the adhesive 600 is not provided for a portion of the flanged member 13 on the side of the discharge tube 100. Therefore, a main surface 13*b* of the flanged member 13 on the side of the discharge tube 100 can be seen from outside the lamp 10. The form of the main surface 13*a* on the side of the base 400, which cannot be seen from outside, can be arbitrarily determined. However, the main surface 13*b* on the side of the discharge tube 100, which can be seen from outside, is preferably flat so as to improve the appearance of the lamp 10. Note that the thickness of the flanged member 13 is not limited to being substantially uniform. For example, only the main surface 13*b* on the side of the discharge tube 100, which can be seen from outside, may be flat, and the main surface 13*a* on the side of the base 400 may not be flat. Furthermore, the shape of the flanged member 13 is not limited to a substantially plate-like shape. For example, the flanged member 13 may have a film-like shape, a block-like shape, etc.

Figure 11:
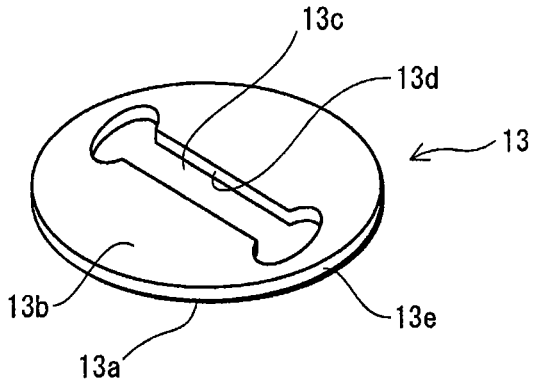
FIG. 11 is a perspective view showing a flanged member according to Modification 2.

FIG. 11 is a perspective view showing a flanged member according to one aspect of the present invention. As shown in FIG. 11, a hole 13*c*, which corresponds to the shape of the sealed portion 201, is formed substantially at the center of the flanged member 13. It is preferable that: the shape of the hole 13*c* is substantially the same as the shape of a cross section of the sealed portion 201 obtained by cutting along a plane perpendicular to the lamp axis X; and an inner circumferential surface 13*d* of the hole 13*c* is in proximity to, and more preferably in contact with, a surface 207 of the sealed portion 201 substantially over the entire circumference, in a state where the flanged member 13 fits around the sealed portion 201.

Note that the shape of the hole 13*c* of the flanged member 13 is not limited to being substantially the same as the shape of the sealed portion 201. The shape of the hole 13*c* may differ from the cross section of the sealed portion 201 to a certain extent.

For example, the shape of the hole 13*c* may entirely or partially have a size smaller than the cross section of the sealed portion 201. In this case, the flanged member 13 may be made of a deformable material having plasticity or elasticity, and preferably further having heat resistance, so that the flanged member 13 fits around the sealed portion 201. With the stated structure, the sealed portion 201 is pressed into the hole 13*c*. In this way, the flanged member 13 is less likely to be misaligned with the sealed portion 201. Furthermore, since the inner circumferential surface 13*d* of the hole 13*c* is more closely in contact with the surface 207 of the sealed portion 201, a gap through which the adhesive 600 leaks is less likely to be formed between the flanged member 13 and the sealed portion 201.

Also, the shape of the hole 13*c* may entirely or partially have a size larger than the cross section of the sealed portion 201. In this case, the inner circumferential surface 13*d* of the hole 13*c* may not be partially in contact with the surface 207 of the sealed portion 201, or the inner circumferential surface 13*d* of the hole 13*c* may be in no contact with the surface 207 of the sealed portion 201. Suppose that the inner circumferential surface 13*d* is not partially in contact with the surface 207 of the sealed portion 201. This structure is acceptable as long as the flanged member 13 is held by the sealed portion 201 at a portion where the inner circumferential surface 13*d* is in contact with the surface 207 of the sealed portion 201. However, a gap, which is formed at a portion where the inner circumferential surface 13*d* is not in contact with the surface 207, preferably has a width small enough to suppress the leakage of the adhesive 600. Specifically, the maximum width of the gap is preferably 1.0 mm or smaller. On the other hand, in the case where the flanged member 13 is in no contact with the sealed portion 201, the flanged member 13 may be fixed to the sealed portion 201 by using an adhesive or the like. The adhesive in this case may be the adhesive 600 for bonding the sealed portion 201 with the outer tube 300.

An outer circumferential surface 13*e* of the flanged member 13 corresponds to an inner circumferential surface of the outer tube 300. The outer diameter of the flanged member 13 is substantially the same in size as the inner diameter of the outer tube 300. The outer circumferential surface 13*e* of the flanged member 13 is in contact with the inner circumferential surface of the outer tube 300 substantially over the entire circumference of the outer circumferential surface 13*e*, in a state where the inner tube 200 is housed in the outer tube 300.

Note that the outer diameter of the flanged member 13 is not limited to being substantially the same as the inner diameter of the outer tube 300, and may differ from the inner diameter of the outer tube 300 to a certain extent.

For example, the outer diameter of the flanged member 13 may be larger than the inner diameter of the outer tube 300. In this case, the flanged member 13 may be made of a deformable material having plasticity or elasticity, and preferably further having heat resistance, so that the flanged member 13 is arranged inside the outer tube 300. In this case, the flanged member 13 is pressed into the outer tube 300, thus making the outer circumferential surface 13*e* of the flanged member 13 in contact with the inner circumferential surface of the outer tube 300. As a result, a gap through which the adhesive 600 leaks is less likely to be formed between the flanged member 13 and the outer tube 300.

Also, the outer diameter of the flanged member 13 may be smaller than the inner diameter of the outer tube 300, and the outer circumferential surface 13*e* may not be in contact with the inner circumferential surface of the outer tube 300 over the entire circumference of the outer circumferential surface 13*e*. In this case, a gap formed between the outer circumferential surface 13*e* and the outer tube 300 preferably has a width small enough to suppress the leak of the adhesive 600. Specifically, the maximum width of the gap is preferably 1.0 mm or smaller.

Furthermore, in the case where the flanged member 13 does not have a substantially circular plate-like shape, but instead has a polygonal plate-like shape or the like, only a part of the outer circumferential surface 13*e* of the flanged member 13 may be in contact with the inner circumferential surface of the outer tube 300. In this case, a gap formed between the outer circumferential surface 13*e* and the outer tube 300 preferably has a width small enough to suppress the leak of the adhesive 600. Specifically, the maximum width of the gap is preferably 1.5 mm or smaller.

The flanged member 13 preferably has hardness lower than the outer tube 300 and the inner tube 200, so as to avoid damaging the outer tube 300 and the inner tube 200. Also, since the temperature of the sealed portion 201 becomes high when the lamp 10 is lit, the flanged member 13 preferably has a heat resistance of 150° C. or higher, more preferably 200° C. or higher, and even more preferably 250° C. or higher. Furthermore, at least a part of the flanged member 13 in the vicinity of the hole 13*c* may be formed from a deformable material having plasticity or elasticity. In this way, even if the outer diameter of the flanged member 13 is larger than the inner diameter of the outer tube 300, the flanged member 13 may be pressed into the outer tube 300. In terms of hardness, heat resistant temperature, and deformability, the flanged member 13 is preferably made of: a metal such as aluminum, stainless steel, or the like; or a mineral such as mica, glass, or the like. Also, the flanged member 13 does not necessarily have a plate-like shape. For example, the flanged member 13 may be made of a metal or a glass fiber in a fine mesh pattern as long as it suppresses the leakage of the adhesive 600.

In addition to the functions described above, the flanged member 13 may also be used to regulate the posture of the outer tube 300 with respect to the inner tube 200, and to match the axis of the inner tube 200 with the axis of the outer tube 300. In this case, it is preferable that the flanged member 13 is in contact with the sealed portion 201 and the outer tube 300.

The sealed portion 201 of the inner tube 200 is bonded with the outer tube 300, with use of the adhesive 600 provided in a portion closer to the base 400 than the flanged member 13. Also, the outer tube 300 is bonded with the base 400 with use of the adhesive 600. Furthermore, it is preferable that the sealed portion 201 is bonded with the base 400 with use of the adhesive 600. This improves the holding strength of the members constituting the lamp 10, resulting in an improvement of resistance against impact such as falling or the like.

Note that the adhesive 600 may be cement or the like. Also, it is acceptable as long as the adhesive 600 is provided to bond at least the sealed portion 201 and the outer tube 300. Then, (i) the connecting between the outer tube 300 and the base 400 and (ii) the connecting between the sealed portion 201 and the base 400 may be achieved by another connecting means, such as another adhesive or a metal member.

The adhesive 600 is provided for a portion of the flanged member 13 on the side of the base 400. The adhesive 600 is provided in the following manner. After being temporarily assembled, the lamp 10 is held such that the base 400 is positioned upward. Next, a nozzle (not shown) of a filling machine is inserted into the base 400 from the through-hole 403 of the base 400. Finally, the adhesive 600 is injected, via the nozzle, into a gap between the sealed portion 201 of the inner tube 200 and the outer tube 300.

When the adhesive 600 is fluidized and still not solidified, the flanged member 13 prevents the adhesive 600 from running downward, i.e., toward the discharge tube 100. Accordingly, the adhesive 600 is prevented from running by the flanged member 13, and becomes solidified in the outer tube 300 at a portion closer to the base 400 than the flanged member 13.

Since being prevented from running by the flanged member 13, the adhesive 600 does not run farther than the sealed portion 201 toward the discharge tube 100. This makes the lamp 10 look beautiful. Also, the height level, in the direction of the lamp axis X, of the adhesive 600 on the side of the discharge tube 100 is uniform by the flanged member 13. This also makes the lamp 10 look beautiful.

Note that in Modification 2, there is no gap between the flanged member 13 and the adhesive 600. In other words, the main surface 13*a* of the flanged member 13 on the side of the base 400 is in contact with the adhesive 600. This makes the lamp 10 look more beautiful. However, it is acceptable if there is a gap between the flanged member 13 and the adhesive 600, over the whole or a part of the main surface 13*a* of the flanged member 13*a* on the side of the base 400.

Also, in Modification 2, the adhesive 600 does not leak farther than the flanged member 13 toward the discharge tube 100, which makes the lamp 10 look even more beautiful. However, the adhesive 600 may leak as long as it does not negatively affect the appearance of the lamp 10.

In Modification 2, the outer circumferential surface 13*e* of the flanged member 13 corresponds to the inner circumferential surface of the outer tube 300, and the flanged member 13 is fit around the sealed portion 201. In this way, the adhesive 600 is prevented from running by the flanged member 13. As a result, the adhesive 600 does not run farther than the sealed portion 201 toward the discharge tube 100. Accordingly, the lamp 10 is less likely to suffer from poor appearance due to inappropriate application of the adhesive 600.

(Modification 3)

Figure 12:
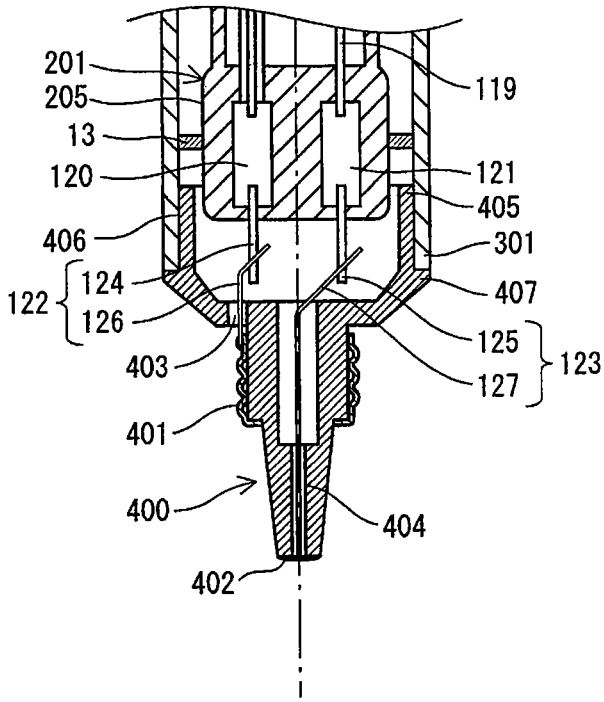
FIG. 12 is for explaining a metal vapor discharge lamp according to Modification 3.

As shown in FIG. 12, the inner tube 200 may be supported by the flanged member 13, without the adhesive 11. Furthermore, the inner tube 200 may be supported by an elastic metal member, such as a clip, provided inside the base 400. This makes it possible to omit a process for bonding between the inner tube 200 and the outer tube 300 or between the inner tube 200 and the base 400.

In conclusion, any of the structures in Modifications 1 to 3, which have been described with reference to FIGS. 9 to 12, prevents the displacement of the axis of the inner tube 200.

(Modification 4)

Figure 13:
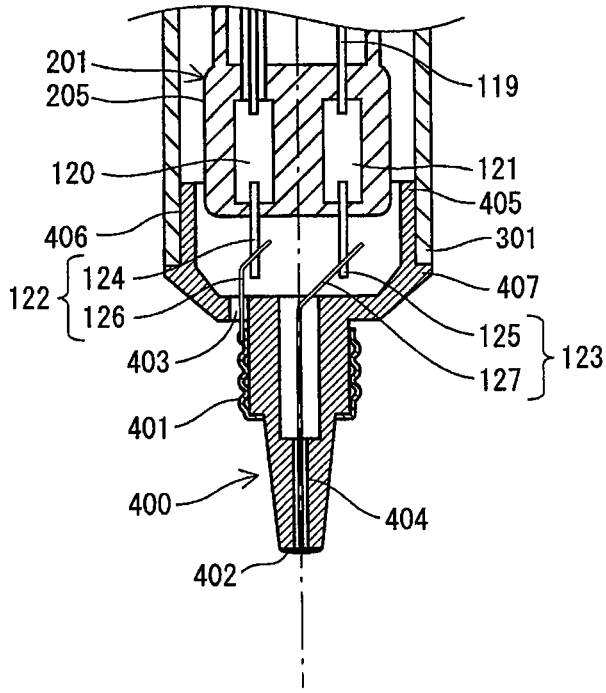
FIG. 13 is for explaining a metal vapor discharge lamp according to Modification 4.

As shown in FIG. 13, the inner tube 200 may be supported only by the lead-in wires 122 and 123, without use of the adhesive 11, the holder 12, the flanged member 13, an elastic metal member, etc.

(Modification 5)

Figure 14:
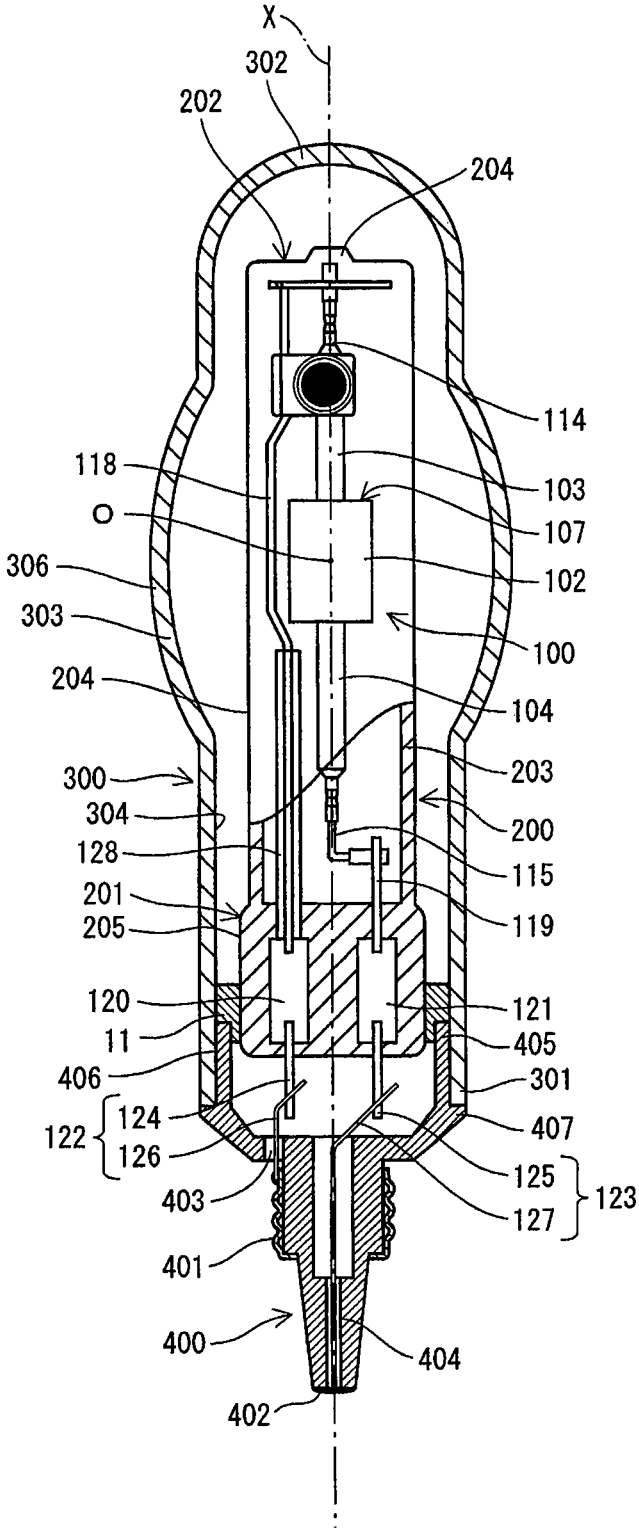
FIG. 14 is for explaining a metal vapor discharge lamp according to Modification 5.

Also, the inner diameter and outer diameter of the middle portion 303 are not necessarily uniform along the lamp axis X. For example, as shown in FIG. 14, the inner diameter and outer diameter of the middle portion 303 may be larger in an area corresponding to the main tube 102 of the discharge tube 100 than in a remaining area of the middle portion 303. In other words, a part of the middle portion 303 may have the bulge 306, so that the middle portion 303 has a middle bulge shape. The bulge 306 suppresses the temperature of the outer tube 300 from rising due to heat from the discharge tube 100. This creates a margin with respect to the strain point of a material constituting the outer tube 300, thus increasing a range of appropriate lighting fixtures selectable as the lighting fixture 20. Furthermore, safety at the time of breakage of the discharge tube 100 is improved. In this case, it is preferable that a gap at the bulge 306, between the inner surface 304 of the outer tube 300 and the outer surface 204 of the inner tube 200, is designed to be 5 mm at a maximum.

(Modification 6)

Figure 15:
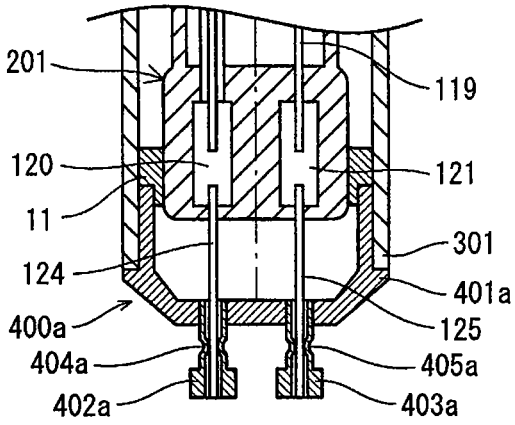
FIG. 15 is for explaining a metal vapor discharge lamp according to Modification 6.

Also, the type of base is not limited to Edison screw type, and may be Swan type as shown in FIG. 15. Specifically, a Swan-type base 400*a* includes: a main portion 401*a*; and a pair of two-level pins 402*a* and 403*a*. The open end portion 301 of the outer tube 300 is attached to the main portion 401*a*. The pair of the two-level pins 402*a* and 403*a* are implanted into the main portion 401*a*. An end of each of the first lead wires 124 and 125 passes through the main portion 401*a* and is inserted into a corresponding one of the two-level pins 402*a* and 403*a*. In this state, the first lead wires 124 and 125 are electrically and mechanically connected to the two-level pins 402*a* and 403*a*, at swaged portions 404*a* and 405*a*.

Also, the base may be made up of two or more components as long as these components are adhered to each other by an adhesive or the like. For example, the base may be made up of: components for electrical connection, such as the shell and the eyelet; a component for holding the outer tube; and a component for supporting the inner tube.

(Modification 7)

Figure 16:
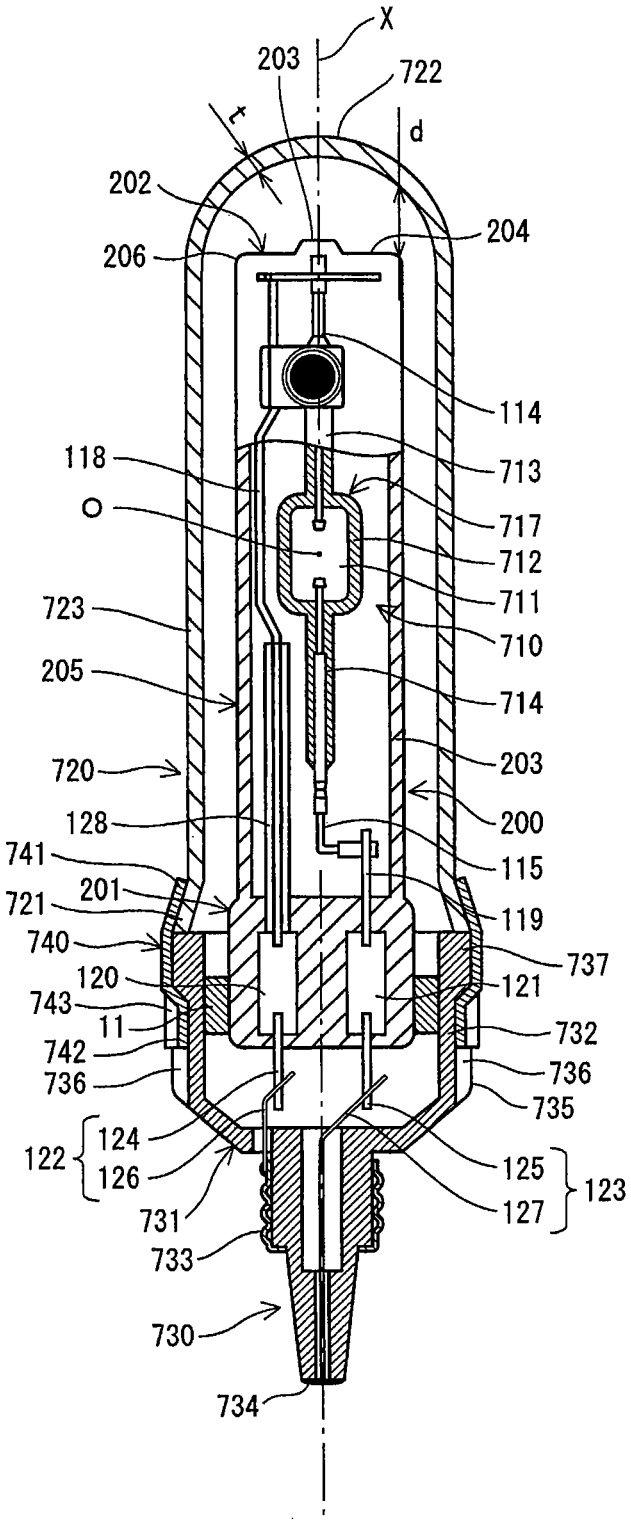
FIG. 16 is for explaining a metal vapor discharge lamp according to Modification 7.

FIG. 16 is for explaining a metal vapor discharge lamp according to Modification 7. As shown in FIG. 16, a discharge tube 710 of the lamp according to Modification 7 is different from the discharge tube 100 as shown in FIG. 3 which is formed by joining three types of components by shrink fitting. Instead, the discharge tube 710 is formed by integrally molding a main tube 712 and narrow tubes 713 and 714. The discharge tube 710 has an envelope 717. The envelope 717 is composed of the main tube 712, and the narrow tubes 713 and 104. The main tube 712 is hermetically sealed, and has a discharge space 711 therein. The narrow tubes 713 and 714 extend from the main tube 712 to respective sides of the discharge tube 710 in a direction of the axis of the discharge tube 710 (the direction coincides with the lamp axis X, which is the central axis of the lamp in the longitudinal direction). Note that the envelope 717 of the discharge tube 710 may be formed by joining a plurality of members by shrink fitting, as seen in the discharge tube 100 in FIG. 3. Alternatively, the envelope 717 may be formed by bonding two members, one of which is formed by integrally molding one of the narrow tubes and a half of the main tube 712 from its center to one end, and the other by integrally molding the other one of the narrow tubes and the other half of the main tube 712.

Regarding the lamp according to Modification 7, an open end portion 721 of an outer tube 720 is connected to a flange 737 of a base 730 by a connecting member 740 which is a part of the base 730.

The outer tube 720 has a bottomed cylindrical shape, and is composed of the open end portion (neck portion) 721, a closed end portion 722, and a middle portion 723. The open end portion 721 is located at one end of the outer tube 720 on the side of the base 730. The closed end portion 722 is located at another end of the outer tube 720 opposite from the end on the side of the base 730. The middle portion 723 is located between the open end portion 721 and the closed end portion 722. The diameter of the open end portion 721 has been gradually increased.

The base 730 has a main body 731 which is tubular. One end of the main body 731 is provided with a tubular portion 732 into which the sealed portion 201 of the inner tube 200 is inserted. Another end of the main body is provided with a shell 733 and an eyelet 734. The flange 737 and a plurality of grooves are formed on an outer circumferential surface 735 of the tubular portion 732 on the side opposite from the shell 733. The flange 737 is located farther from the shell 733 than the grooves 736, and the outer diameter of the tubular portion 732 is maximum at the flange 737. The grooves 736 are formed along the lamp axis X, closer to the shell 733 than the flange 733. The grooves 736 are provided substantially at equal intervals in the circumferential direction of the outer circumferential surface 735. In this way, on the outer circumferential surface 735, the outer diameter of the tubular portion 732 is maximum at the flange 737, and is minimum at the grooves 736.

The connecting member 740 is a metal tube, for example, and spans the open end portion 721 of the outer tube 720, and the flange 737 and the grooves 736 at the tubular portion 732 of the base 730. The connecting member 740 is fit around the open end portion 721 and the tubular portion 732. The inner diameter of a portion 741 of the connecting member 740 on the side of the outer tube 720 is larger than the outer diameter of the open end portion 721 of the outer tube 720. The inner diameter of a portion 742 of the connecting member 740 on the side of the base 730 is larger than the outer diameter of the tubular portion 732 of the base 730.

The portion 741 of the connecting member 740 on the side of the outer tube 720 decreases in diameter along the shape of the open end portion 721 of the outer tube 720, so that the open end portion 721 of the outer tube 720 does not come off from the connecting member 740. The portion 742 of the connecting member 740 on the side of the base 730 is provided with a plurality of swaged portions 743 which correspond to the grooves 736 of the tubular portion 732. The swaged portions 743 prevent the tubular portion 732 from coming off from the connecting member 740.

As described above, the connecting member 740 connects the outer tube 720 and the base 730. Such a structure allows the outer tube 720 to have a different thermal expansion coefficient from the base 730. This ensures a wider range of lamp designs. For example, an outer tube made of quartz glass has higher heat resistance than an outer tube made of hard glass. However, the outer tube made of quartz glass has thermal expansion coefficient too different from that of the base 730, which makes it difficult for the outer tube to be connected to the base 730 without causing a problem. However, with the stated structure, an outer tube made of quartz glass can be appropriately connected to the base 730.

Note that the connecting member 740 is not limited to being made of metal. However, it is preferable that the connecting member 740 is made of a material having malleability and plasticity so as to ensure a reliable connection between the open end portion 721 of the outer tube 720 and the flange 737 of the base 730. A material having malleability and plasticity can absorb impact at the time of rupture of the discharge tube 710, making it less likely for the outer tube 720 to come off from the base 730 by impact. Also, as described above, the connecting member 740 has the decreased diameter structure and the swaging structure, thereby connecting the open end portion 721 of the outer tube 720 with the flange 737 of the base 730. However, the connection by the connection member 740 may be realized by a mechanical structure, such as an engaging structure, different from the aforementioned structures.

(Modification 8)

A lamp according to Modification 8 may comprise: a discharge tube; an inner tube; an outer tube; a base; and a pair of lead wires. The discharge tube is housed in the inner tube. The inner tube has a sealed portion at one end, and is fixed to the base by an adhesive. The pair of lead wires extend from the one end of the inner tube. The inner tube is housed in the outer tube, and one end of the outer tube is attached to the base. The base has a wall surrounding the sealed portion. The adhesive is applied between the one end of the inner tube and the wall of the base, and is spaced apart from at least one of the pair of lead wires extending from the one end of the inner tube. With this structure, the pair of lead wires are not connected to each other via the adhesive, thus preventing electrical failure.

Figure 17:
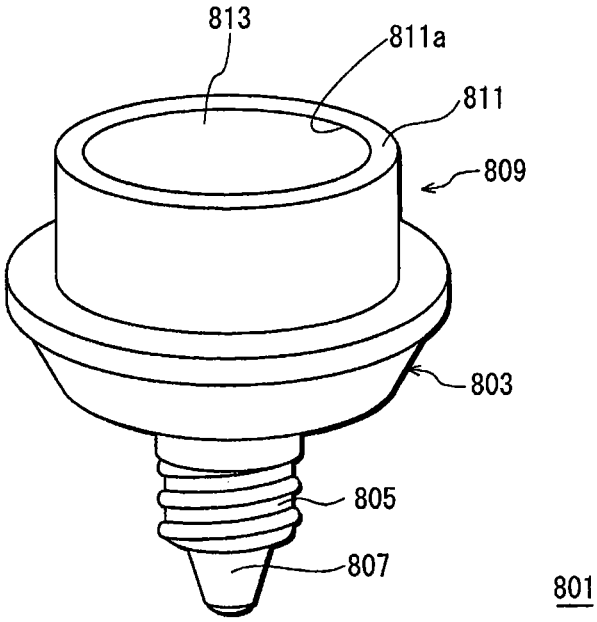
FIG. 17 is a perspective view showing a base according to Modification 8.

FIG. 17 is a perspective view showing a base according to Modification 8. As shown in FIG. 17, a base 801 includes a main body 803, a shell 805, and an eyelet 807. Out of one and another ends of the main body 803, the shell 805 is provided at the other end of the main body 803.

Figure 18:
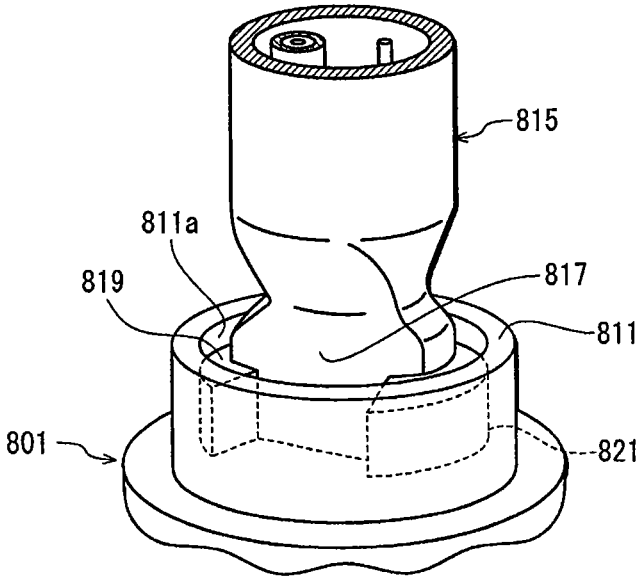
FIG. 18 is a perspective view showing an inner tube and the base according to Modification 8.

A connecting portion 809 is provided at the one end of the main body 803. A tubular portion 811, which is tubular, is also provided at the one end of the main body 803. The inside of the tubular portion 811 is hollow to form a recess 813. As shown in FIG. 18, an inner tube 815 is mounted on the base 801, in a state where a sealed portion 817 of the inner tube 815 is inserted in the recess 813. The sealed portion 817 is bonded with an inner surface of the tubular portion 811 with adhesives 819 and 821 provided in the recess 813.

The tubular portion 811 is provided for the main body 803 so as to surround the sealed portion 817. The tubular portion 811 is equivalent to the "wall" of the present invention. Also, when the tubular portion 811 of the base 801 is viewed from an axis direction of the inner tube 815 (i.e., an axis direction of the outer tube 823), an outer circumferential surface of the tubular portion 811 corresponds to an inner circumferential surface of one end portion of an outer tube 823.

Figure 19:
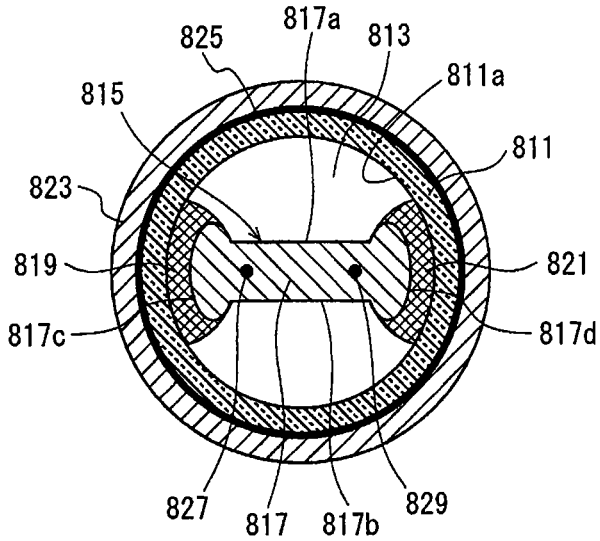
FIG. 19 is a sectional view showing a connecting portion at which the inner tube and the base according to Modification 8 are connected.

As shown in FIG. 19, the outer tube 823 is fixed to the base 801 with an adhesive 825, in a state where the tubular portion 811 of the connecting portion 809 is covered by the outer tube 823, i.e., in a state where the tubular portion 811 is inserted in the one end portion of the outer tube 823. The cross section of the one end portion of the outer tube 823 has an annular shape, for example. The cross section of the tubular portion 811 of the base 801 also has an annular shape. The tubular portion 811 fits in the outer tube 823 in a state where a circumferential wall of the tubular portion 811 faces the inner circumferential surface of the outer tube 823 over an entire circumference.

The sealed portion 817 of the inner tube 815 is formed by heating the one end of the inner tube 815 and crushing it flatly (i.e., pinch-sealing) with a pinching device. Accordingly, the inner tube 815 has: flat surfaces 817*a* and 817*b*; and bulging surfaces 817*c* and 817*d*, as shown in FIG. 19. The flat surfaces 817*a* and 817*b* are the outer surfaces of portions of the inner tube 815, which made contact with the pinching device while being pressured by the pinching device. The bulging surfaces 817*c* and 817*d* are the outer surfaces of portions of the inner tube 815, which were not in contact with the pinching device while being pressured by the pinching device, and therefore were bulged through the pinching device in a direction perpendicular to a pressuring direction.

The adhesive 819 in the recess 813 is provided between the bulging surface 817*c* of the sealed portion 817 and an inner surface (811*a*) of the tubular portion 811 so as to fix the bulging surface 817*c* and the inner surface 811 *a*. The adhesive 821 in the recess 813 is provided between the bulging surface 817*d* of the sealed portion 817 and the inner surface 811 a of the tubular portion 811 so as to fix the bulging surface 817*d* and the inner surface 811*a*. The adhesives 819 and 821 are not in contact with each other. Also, the adhesives 819 and 821 are provided only in a portion within the recess 813. As a result, the adhesives 819 and 821 in the recess 813 are not easily seen from outside the lamp, thus reducing the impairment of design in terms of appearance.

In the process of mounting the inner tube 815 on the base 801, the base 801 is arranged such that an opening of the tubular portion 811 faces upward. Next, the sealed portion 817 of the inner tube 815 is inserted into the tubular portion 811. At this point, a pair of lead wires 827 and 829, which extend from the one end of the inner tube 815, are passed through a pair of through-holes provided at the bottom of the tubular portion 811.

Then, the posture of the inner tube 815 is adjusted, and the inner tube 815 is positioned with respect to the base 801. After that, (i) the adhesive 819 is injected in a first area between the bulging surface 817*c* of the sealed portion 817 and a portion of the inner circumferential surface 811*a* of the tubular portion 811, the portion facing the bulging surface 817*c*, and (ii) the adhesive 821 is injected in a second area, which is spaced apart from the first area, between the bulging surface 817*d* of the sealed portion 817 and a portion of the inner circumferential surface 811*a* of the tubular portion 811, the portion facing the bulging surface 817*d*. With these adhesives 819 and 821, the inner tube 815 is fixed to the base 801.

At this point, the adhesives 819 and 821 are positioned independently from each other on a straight line connecting the pair of lead wires 827 and 829 in plan view. Therefore, even if the adhesives 819 and 821 flow to an area other than the sealed portion 817, the pair of lead wires 827 and 829 do not electrically get connected to each other via the adhesives 819 and 821. This prevents electrical shorting caused by the adhesives 819 and 821 absorbing moisture. It is preferable that the adhesives 819 and 821 are prevented from flowing through an area between the lead wires 827 and 829. This enables maintaining an insulation distance between the lead wires 827 and 829 which mutually have opposite polarities.

After the inner tube 815 is fixed to the base 801, the adhesive 825 is applied to at least one of (i) the inner circumferential surface of the one end portion of the outer tube 823 and (ii) the outer circumferential surface of the tubular portion 811 of the base 801. Then, the tubular portion 811 of the base 801 is covered with the one end portion of the outer tube 823, whereby the base 801 is fixed to the outer tube 823 with the adhesive 825.

In the lamp structure as described above, the outer tube 823 is fixed to the base 801. This reduces strain on the inner tube 815 when mounting the lamp, since the user mounts the lamp by holding and screwing the outer tube 823 into the socket of the lighting fixture. Accordingly, the bonding strength between the inner tube 815 and the base 801 is sufficient as long as it can maintain the positions of the inner tube 815 and the base 801. This makes it possible to reduce the amount of the adhesives 819 and 821 used to fix the inner tube 815 to the base 801.

(Modification 9)

According to Modification 8, the recess 813 of the base 801 is circular in plan view. However, the planar shape of the recess may be different. The following describes an example of a recess whose planar shape is different from a circular shape.

Figure 20:
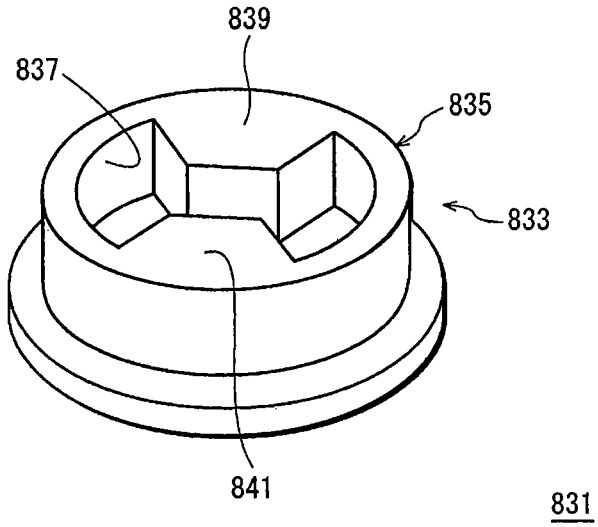
FIG. 20 is a perspective view showing a base according to Modification 9.

FIG. 20 is a perspective view showing a part of a base according to Modification 9. As shown in FIG. 20, a connecting portion 833 of a base 831 includes a tubular portion 835, and a part of an inner circumferential surface 837 of the tubular portion 835 is protruded toward the central axis of the tubular portion 835. In other words, the tubular portion 835 has protruded areas 839 and 841 which are protruded toward the central axis of the tubular portion 835.

When the sealed portion 817 of the inner tube 815 is inserted into the tubular portion 835, the protruded areas 839 and 841 respectively make contact with the flat surfaces 817*a* and 817*b* of the sealed portion 817. Here, it is possible to set the thickness of the sealed portion 817 (i.e., thickness in a direction perpendicular to an imaginary line connecting the pair of lead wires 827 and 829) to be substantially uniform by adjusting a distance between a pair of pinchers of the pinching device during the sealing process. The degree of protrusion of the protruded areas 839 and 841 can be determined in accordance with the aforementioned distance.

Figure 21A:
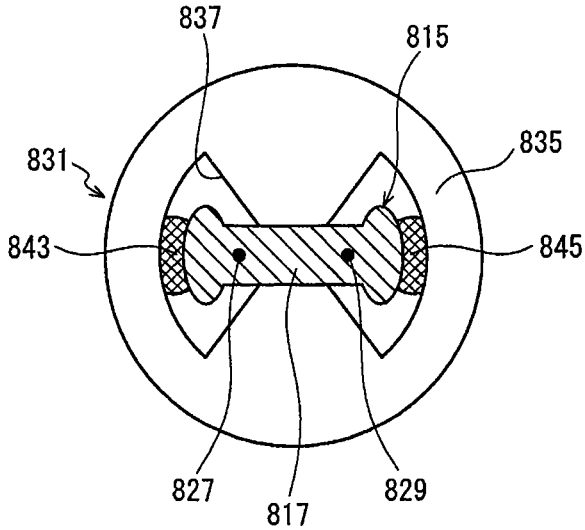
FIGS. 21A to 21C are each a sectional view showing a connecting portion at which the inner tube and the base according to Modification 9 are connected.
Figure 21B:
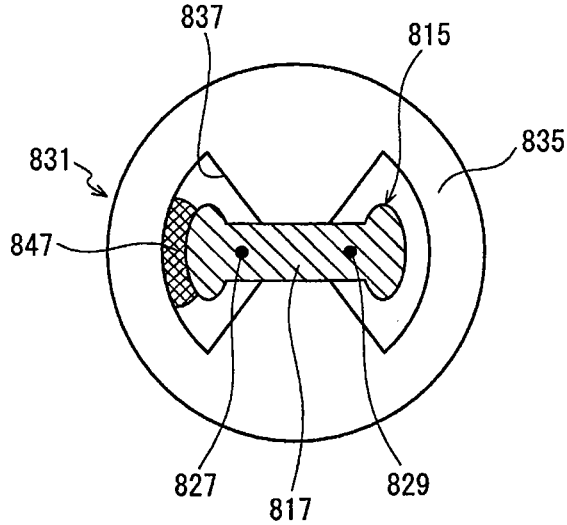
Figure 21C:
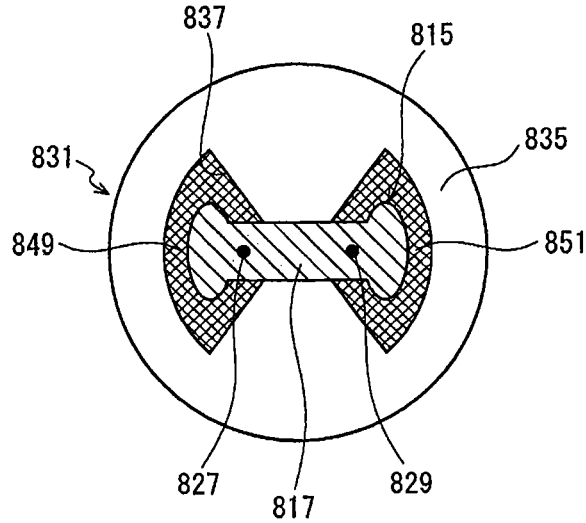

FIGS. 21A to 21C are sectional views showing a connecting portion at which the inner tube and the base according to Modification 9 are connected. As shown in FIGS. 21A to 21C, an adhesive is provided for at least one of two areas located outside the sealed portion 817, in a direction along the extension of the imaginary line connecting the lead wires 827 and 829 (hereinafter, also referred to as "direction of the imaginary line") on a plane perpendicular to the axis of the inner tube 815 having the sealed portion 817. In other words, an adhesive is provided in at least one of two areas formed between the sealed portion 817 and the tubular portion 835 of the base 831, in the direction of the imaginary line connecting the lead wires 827 and 829.

In the case of FIG. 21A, adhesives 843 and 845 for fixing the base 831 and the inner tube 815 are provided in the same manner as in Modification 8. Specifically, the adhesive 843 is provided between the bulging surface 817*c* of the sealed portion 817 and a portion of the inner circumferential surface 837 of the tubular portion 835, the portion facing the bulging surface 817*c*. Also, the adhesive 845 is provided between the bulging surface 817*d* of the sealed portion 817 and a portion of the inner circumferential surface 837 of the tubular portion 835, the portion facing the bulging surface 817*d*. Similarly to Modification 8, the adhesives 843 and 845 are positioned on the imaginary straight line connecting the pair of lead wires 827 and 829 in plan view.

In FIG. 21A, each of the adhesives 843 and 845 is independently provided in a corresponding one of two areas. However, in FIG. 21B, an adhesive is provided in a single area. In other words, an adhesive 847 is provided for one of the following two areas: (i) the area between the bulging surface 817*c* of the sealed portion 817 and a portion of the inner circumferential surface 837 of the tubular portion 835, the portion facing the bulging surface 817*c*; and (ii) the area between the bulging surface 817*d* of the sealed portion 817 and a portion of the inner circumferential surface 837 of the tubular portion 835, the portion facing the bulging surface 817*d*. Similarly to Modification 8, the adhesive 847 is positioned on the imaginary line connecting the pair of lead wires 827 and 829. However, the adhesive 847 does not always need to be positioned on the imaginary line.

In FIG. 21A, the adhesives 843 and 845 are provided with spaces in the recess of the tubular portion 835. In FIG. 21C, however, the spaces between the inner circumferential surface 837 of the tubular portion 835 and the sealed portion 817 are completely filled with adhesives 849 and 851. Even in such a case, the adhesive 849 is spaced apart from the lead wire 829, and the adhesive 851 is spaced apart from the lead wire 827. Accordingly, even if the adhesives 849 and 851 flow out, they are not likely to make contact with either of the lead wires 827 and 829.

As described above, the adhesive is provided for at least one of the following portions in the direction of the imaginary line: (i) one side portion of the sealed portion 817 (a part of the outer perimeter of the sealed portion 817), which includes the lead wire 827 and is spaced apart from the lead wire 829; and (ii) another side portion of the sealed portion 817 (another part of the outer perimeter of the sealed portion 817), which includes the lead wire 829 and is spaced apart from the lead wire 827. This enables increasing the distance between the adhesives, thus improving security.

Note that in Modifications 8 and 9, the adhesive is provided for the sealed portion 817 in the direction of the imaginary line connecting the lead wires 827 and 829. However, the adhesive may be provided in a space that includes at least one of flat surfaces of the sealed portions 817 in the direction of the imaginary line connecting the lead wires 827 and 829, one of the flat surfaces including the lead wire 827 and is spaced apart from the lead wire 829 (e.g., the flat surface 817*a* in FIG. 19), the other one of the flat surfaces including the lead wire 829 and is spaced apart from the lead wire 827 (e.g., the flat surface 817*b* in FIG. 19).

(Modification 10)

According to Modification 8, the base 801 includes the main body 803 having the connecting portion 809, and the shell 805 and the eyelet 807 are mounted on the main body 803. Also, according to Modification 9, the base 831 includes the main body 803 having the connecting portion 833, and the shell 805 and the eyelet 807 are mounted on the main body 803. However, it is not limited to such. For example, a member having a base portion may be provided separately from a member on which the shell and the eyelet are mounted. The following describes such a case as Modification 10.

Figure 22:
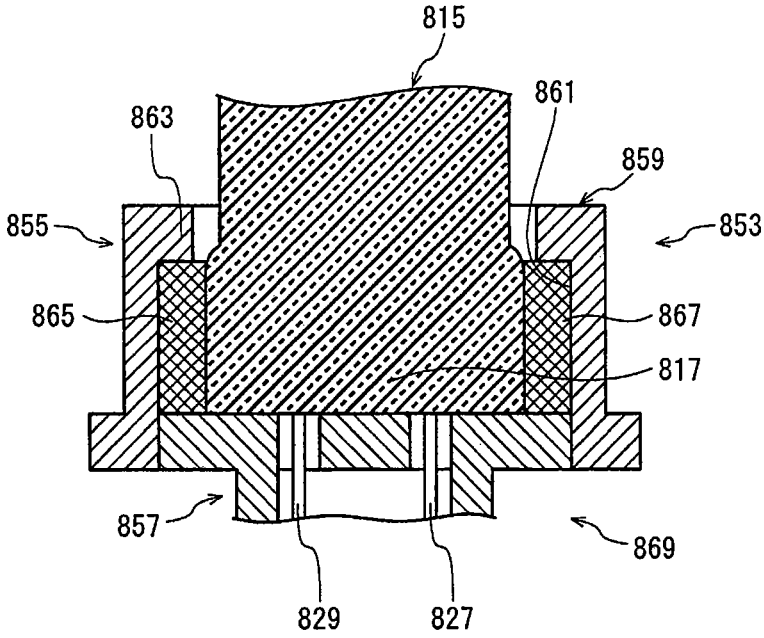
FIG. 22 is a sectional view showing a connecting portion at which the inner tube and a base according to Modification 10 are connected.

FIG. 22 is a sectional view showing a connecting portion at which the inner tube and a base according to Modification 10 are connected. FIG. 22 shows only a base 853, on which the inner tube 815 has already been mounted.

As shown in FIG. 22, the base 853 according to Modification 10 includes a tubular member 855 and a lid 857. The tubular member 855 includes a connecting portion 859 at which the inner tube 815 (sealed portion 817) inserted in an opening (i.e., a recess) of the tubular member 855 is connected to the base 853. An inner surface 861 of the tubular member 855 is provided with a protrusion 863 which protrudes toward the opening of the tubular member 855. Specifically, the protrusion 863 is provided at an end of the tubular member 855 on the side of the opening. Also, adhesives 865 and 867 are provided at two different areas between the sealed portion 817 and the tubular member 855. In this way, the inner tube 815 is fixed to the tubular member 855.

Note that in Modification 10, the inner tube 815 is fixed to the base 853 with the adhesives 865 and 867. However, it is not limited to such. Instead of the adhesives 865 and 867, it is possible to use a member for regulating the movements of the inner tube 815 and the base 853, such as a filling member for filling the spaces between the inner tube 815 and the base 853.

The filling member may be provided in a portion along the imaginary line connecting the lead wires 827 and 829, or may instead be provided in another portion, similarly to Modification 8, etc. Note that the filling member needs to be provided within a space between the inner tube 815 and the base 853. In the present embodiment, for example, the protrusion 863 is brought into contact with the filling member, so that the filling member does not escape from the space between the inner tube 815 and the base 853.

A base portion 869 includes the lid 857, a shell and an eyelet (not shown) which are mounted on the lid 857. Note that the lid 857 is connected to the tubular member 855 with use of, for example, an adhesive.

(Modification 11)

Figure 23:
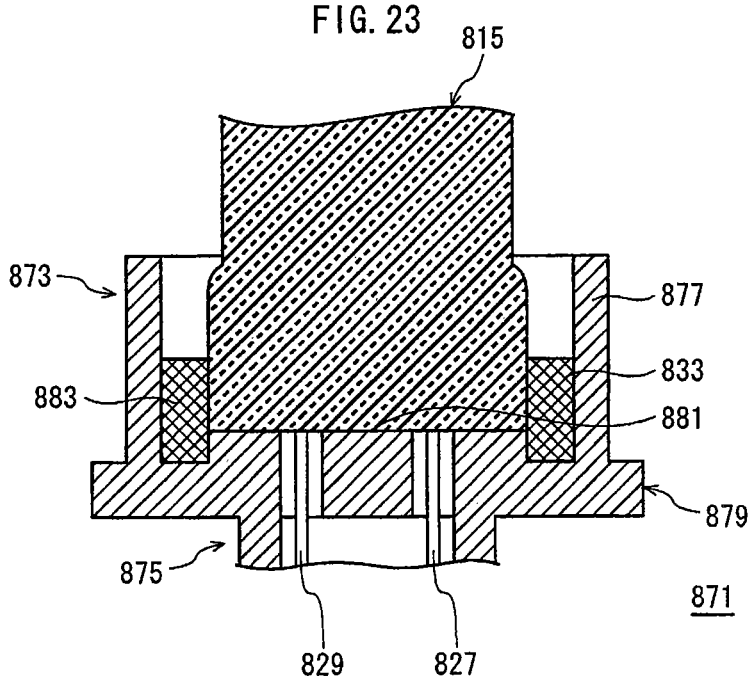
FIG. 23 is a sectional view showing a connecting portion at which the inner tube and a base according to Modification 11 are connected.
Figure 24:
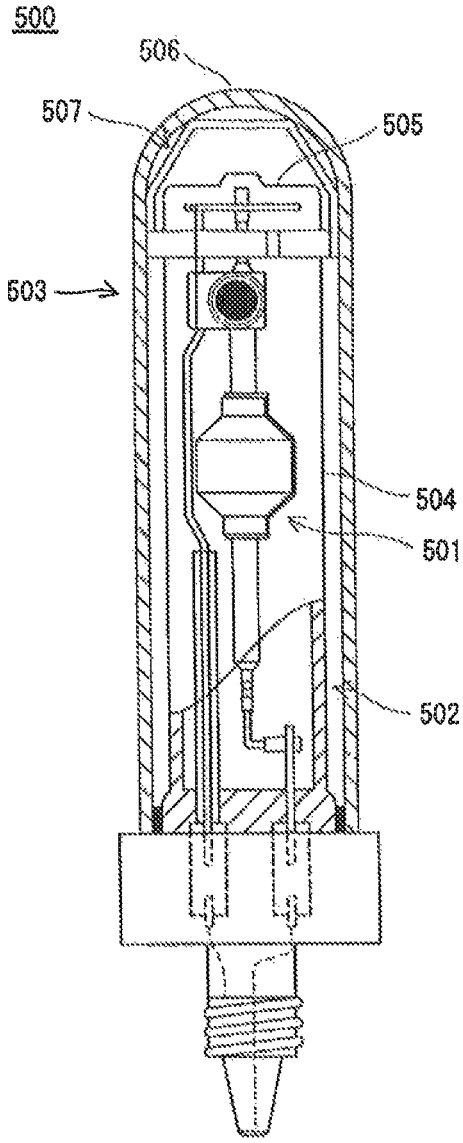
FIG. 24 PRIOR ART
FIG. 24 is a partial cutaway side view showing a conventional metal halide lamp.

FIG. 23 is a sectional view showing a connecting portion at which the inner tube and a base according to Modification 11 are connected. FIG. 23 shows only a base 871, on which the inner tube 815 has already been mounted, similarly to FIG. 22.

As shown in FIG. 23, the base 871 according to Modification 11 includes a connecting portion 873 and a base portion 875. Note that the base portion 875 has the same structure as in Modification 8, etc.; therefore, a description thereof is omitted.

The connecting portion 873 has a tubular member 877 and an elevated area 881. The elevated area 881 is formed by elevating the bottom of a main body 879 of the base 871, namely the center of the inner bottom of the recess of the tubular member 877, toward the opening of the tubular member 877. The main body 879 has through-holes at the bottom thereof for the lead wires 827 and 829 which extend from the one end of the inner tube 815.

The inner tube 815 is bonded with the connecting portion 873 with adhesives 883 and 885. Specifically, the adhesives 883 and 885 are applied between the sealed portion 817 and the tubular member 877, in a state where the one end portion of the inner tube 815 is in contact with the elevated area 881 of the recess of the tubular member 877. As described above, the connecting portion 873 has the elevated area 881 at the bottom of the recess of the tubular member 877. This suppresses the flow of the adhesives 883 and 885 in the recess, thus preventing the adhesives 883 and 885 from making contact with the lead wires 827 and 829.

INDUSTRIAL APPLICABILITY

The present invention is applicable to a metal vapor discharge lamp having a triple tube structure and including a discharge tube, an inner tube, and an outer tube.

REFERENCE SIGNS LIST

1 lighting apparatus
10 metal vapor discharge lamp
100 and 710 discharge tube
200 and 815 inner tube
202 end portion
204 outer surface
300 and 720 outer tube
301 and 721 open end portion
302 and 722 closed end portion
304 inner surface
400 and 730 base

The invention claimed is:

1. A metal vapor discharge lamp comprising:
an outer tube having an open end portion at one end and a closed end portion at another end;
an inner tube housed in the outer tube;
a discharge tube housed in the inner tube; and
a base attached to the open end portion of the outer tube, wherein
relationships of $t \geqq 1.1 \times d^{-0.4}$; $0<d$; and $0.3 \leqq t$ are satisfied, where t denotes a minimum thickness, in millimeters, of the closed end portion of the outer tube, d denotes a shortest distance, in millimeters, in a direction of a longitudinal axis of the outer tube, between an inner surface of the closed end portion of the outer tube and an outer surface of an end portion of the inner tube, the end portion being located opposite from the base.

2. The metal vapor discharge lamp of claim 1 wherein
the end portion of the inner tube located opposite from the base has a substantially hemispherical shape.

3. The metal vapor discharge lamp of claim 1 wherein
the inner surface of the closed end portion of the outer tube is one of a substantially flat surface and a curved surface having a radius of curvature R of 8.0 mm or larger.

4. The metal vapor discharge lamp of claim 1 having a power consumption in a range from 30 W to 80 W inclusive.

5. The metal vapor discharge lamp of claim 1 wherein
the shortest distance d is 15 mm or smaller.

6. The metal vapor discharge lamp of claim 1 wherein
the minimum thickness t is in a range from 1.1 mm to 3.0 mm inclusive.

7. The metal vapor discharge lamp of claim 1 wherein
the outer tube is made of one of hard glass, quartz glass, and alumina ceramic.

8. A lighting apparatus comprising:
the metal vapor discharge lamp of claim 1; and
a reflector configured to reflect light emitted from the metal vapor discharge lamp in a desired direction.

9. A metal vapor discharge lamp comprising:
an outer tube having an open end portion at one end and a closed end portion at another end;
an inner tube housed in the outer tube;
a discharge tube housed in the inner tube; and a base attached to the open end portion of the outer tube, wherein relationships of $t \geqq 1.1 \times d^{-0.4}$; $0 < d$; and $0.3 \geqq t$ are satisfied, where t denotes a minimum thickness, in millimeters, of the closed end portion of the outer tube, d denotes a shortest distance, in millimeters, in a parallel direction that is offset from a longitudinal axis of the outer tube, between an inner surface of the closed end portion of the outer tube and an outer surface of an end portion of the inner tube, the end portion being located opposite from the base.

10. The metal vapor discharge lamp of claim 9 wherein the end portion of the inner tube located opposite from the base has a substantially hemispherical shape.

11. The metal vapor discharge lamp of claim 9 wherein the inner surface of the closed end portion of the outer tube is one of a substantially flat surface and a curved surface having a radius of curvature R of 8.0 mm or larger.

12. The metal vapor discharge lamp of claim 1 having a power consumption in a range from 30 W to 80 W inclusive.

13. The metal vapor discharge lamp of claim 9 wherein the shortest distance d is 15 mm or smaller.

14. The metal vapor discharge lamp of claim 13 wherein the minimum thickness t is in a range from 1.1 mm to 3.0 mm inclusive.

15. The metal vapor discharge lamp of claim 1 wherein the outer tube is made of one of hard glass, quartz glass, and alumina ceramic.

16. A lighting apparatus comprising:

the metal vapor discharge lamp of claim 9; and a reflector configured to reflect light emitted from the metal vapor discharge lamp in a desired direction.

* * * * *